US011930853B2

(12) United States Patent
Liu et al.

(10) Patent No.: US 11,930,853 B2
(45) Date of Patent: Mar. 19, 2024

(54) ELECTRONIC CIGARETTE ATOMIZER AND ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Xinqiang Yin, Hunan (CN); Jianhua Yi, Hunan (CN); Lizhou Shen, Hunan (CN); Yongquan Zhou, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 618 days.

(21) Appl. No.: 17/254,766

(22) PCT Filed: Jun. 20, 2019

(86) PCT No.: PCT/CN2019/092072
§ 371 (c)(1),
(2) Date: Dec. 21, 2020

(87) PCT Pub. No.: WO2019/242685
PCT Pub. Date: Dec. 26, 2019

(65) Prior Publication Data

US 2021/0274847 A1 Sep. 9, 2021

(30) Foreign Application Priority Data

Jun. 22, 2018 (CN) ..... 201810649779.8
Jun. 22, 2018 (CN) ..... 201820978046.4
Jun. 22, 2018 (CN) ..... 201820978048.3

(51) Int. Cl.
*A24F 40/485* (2020.01)
*A24F 40/10* (2020.01)

(52) U.S. Cl.
CPC ..... *A24F 40/485* (2020.01); *A24F 40/10* (2020.01)

(58) Field of Classification Search
CPC ..... A24F 40/485; A24F 40/10; A24F 40/05; A24F 40/40; A24F 40/42; B05B 17/0607
See application file for complete search history.

(56) References Cited

U.S. PATENT DOCUMENTS

2016/0015081 A1* 1/2016 Liu ..... H05B 3/16 131/329
2016/0073690 A1* 3/2016 Liu ..... H05B 1/0297 131/329

(Continued)

FOREIGN PATENT DOCUMENTS

CN 203986108 U 12/2014
CN 105105339 A 12/2015

(Continued)

OTHER PUBLICATIONS

International Search Report issued in International Application No. PCT/CN2019/092072 dated Sep. 4, 2019, 2 pages.

*Primary Examiner* — Abdullah A Riyami
*Assistant Examiner* — Nader J Alhawamdeh
(74) *Attorney, Agent, or Firm* — MASCHOFF BRENNAN; Ran Pang; Michael Mauriel

(57) ABSTRACT

An electronic cigarette atomizer and an electronic cigarette are disclosed. The electronic cigarette atomizer comprises an air inlet (1), an air inlet passage (2), an atomization cavity (3), an air outlet passage (4), an air outlet (5), and a suction nozzle (6) that are communicated in sequence. The electronic cigarette atomizer further comprises a housing (8) and an adjustment mechanism (7) for adjusting the air input of (Continued)

the air inlet (1). The air inlet passage (2), the atomization cavity (3), and the air outlet passage (4) are all arranged in the housing (8), and a top of the housing (8) is provided with a top cover (9). The adjustment mechanism (7) comprises a movable member (10) located in the top cover (9) and movable axially along the top cover (9).

20 Claims, 18 Drawing Sheets

(56) References Cited

U.S. PATENT DOCUMENTS

| | | | | |
|---|---|---|---|---|
| 2017/0105451 | A1 | 4/2017 | Fornarelli | |
| 2019/0183176 | A1* | 6/2019 | Liu | A24F 40/05 |
| 2019/0246704 | A1* | 8/2019 | Liu | A24F 40/485 |
| 2021/0267278 | A1* | 9/2021 | Liu | A24F 7/02 |
| 2021/0267279 | A1* | 9/2021 | Liu | A24F 40/05 |
| 2021/0274847 | A1* | 9/2021 | Liu | A24F 40/485 |
| 2022/0142246 | A1* | 5/2022 | Liu | A24F 40/40 |
| 2022/0151301 | A1* | 5/2022 | Liu | A24F 40/42 |

FOREIGN PATENT DOCUMENTS

| | | | | |
|---|---|---|---|---|
| CN | 205757176 | U * | 12/2016 | A24F 40/485 |
| CN | 106418727 | A | 2/2017 | |
| CN | 206542921 | U | 10/2017 | |
| CN | 208354605 | U | 1/2019 | |
| CN | 208354606 | U | 1/2019 | |
| JP | 2014504852 | A | 2/2014 | |

* cited by examiner

ELECTRONIC CIGARETTE ATOMIZER AND ELECTRONIC CIGARETTE

CROSS REFERENCE TO RELATED APPLICATIONS

This application is a U.S. National Phase application under 35 U.S.C. § 371 of International Application No. PCT/CN2019/092072 filed on Jun. 20, 2019, which claims priority to Chinese Application No. 201810649779.8 filed on Jun. 22, 2018, Chinese Application No. 201820978046.4 filed on Jun. 22, 2018, and Chinese Application No. 201820978048.3 filed on Jun. 22, 2018. The entire contents of these applications are hereby incorporated herein by reference.

FIELD OF THE INVENTION

The present invention relates to an electronic cigarette atomizer and an electronic cigarette.

BACKGROUND OF THE INVENTION

In an electronic cigarette atomizer, an air inlet, an air inlet passage, an atomization cavity, an air outlet passage, an air outlet, and a suction nozzle are communicated in sequence. When smoking, air enters the atomization cavity from the air inlet through the air inlet passage, and takes away smoke in the atomization cavity, and then the smoke enters the user's mouth through the air outlet passage, the air outlet and the suction nozzle in turn for the user to smoke.

In the prior art, in order to meet the needs of users with different lung capacities for smoking air flow, an air adjusting ring is generally arranged at the air inlet. The size of the air inlet is adjusted by using the air adjusting ring. This adjustment mode has the following disadvantages:

First, in the process of rotating the air adjusting ring, the sealing ring between the air adjusting ring and the air inlet is prone to fold deformation or slippage, resulting in poor sealing performance, instable air input after adjustment, and inconvenient adjustment. The holding portion of the air adjusting ring is very small, difficult to focus and difficult to control and adjust the force, resulting in difficult adjustment to the required air input, and poor user experience. In addition, because the air adjusting ring is arranged outside, a child can easily turn the air adjusting ring at will, so that the user needs to adjust the required air input again during reuse, which is inconvenient to use.

Second, in the process of rotating the air adjusting ring, the relative position between the outlet of the air inlet passage and the atomization cavity is unchanged. When the air input is reduced, due to the increase in smoking resistance, the velocity of air flow in the atomization cavity slows down, which weakens the smoke emitting effect, and decreases the concentration of smoke, thereby affecting the use.

Third, no e-liquid recovery structure is arranged at the suction nozzle, so e-liquid is easily accumulated and then sucked by the user.

In addition, when the e-liquid bin in the housing of the electronic cigarette atomizer needs to be filled with e-liquid, the top cover on the housing is rotated to expose the e-liquid filling hole to fill the e-liquid. This e-liquid filling mode in the prior art has the following disadvantages:

First, the electronic cigarette is small, and the top cover is smaller, so the operation is inconvenient and time-consuming.

Second, the top cover can be opened at will, so it is easily opened by children to cause e-liquid leakage.

SUMMARY OF THE INVENTION

The purpose of the present invention is, in view of the shortcomings of the prior art, to provide an electronic cigarette atomizer and an electronic cigarette, which can quickly and conveniently adjust the required air flow, have good sealing performance, do not affect the smoke emitting effect during the adjustment, avoid sucking e-liquid. The e-liquid filling operation is simple, convenient, time-saving and effort-saving, and can prevent e-liquid leakage due to misoperation.

In order to solve the above technical problems, the technical solution adopted by the present invention is as follows:

An electronic cigarette atomizer comprises an air inlet, an air inlet passage, an atomization cavity, an air outlet passage, an air outlet, and a suction nozzle that are communicated in sequence, and further comprises a housing and an adjustment mechanism for adjusting the air input of the air inlet; the air inlet passage, the atomization cavity, and the air outlet passage are all arranged in the housing, and a top of the housing is provided with a top cover; the adjustment mechanism comprises a movable member located in the top cover and movable axially along the top cover, the movable member is provided with an air passing hole that communicates the air inlet with the air inlet passage, and when the movable member moves axially along the top cover, the air passing hole on the movable member moves in a misaligned manner relative to the air inlet to adjust the amount of air entering the air inlet passage.

With the above structure, the axial movement of the movable member is linear movement. When the movable member moves axially along the top cover, the air passing hole on the movable member moves in a misaligned manner relative to the air inlet to change the air inlet area, thereby adjusting the air input of the air inlet; the adjustment is convenient and quick, the sealing performance is good, the stability of linear movement is good, the air input is stable after adjustment, and the phenomenon of jamming or slipping does not occur. Meanwhile, the movable member is invisibly arranged in the atomizer, so it is difficult to identify the corresponding position of the air input adjustment structure from the appearance, therefore the overall sense of appearance is maintained, and the situation of child takes the atomizer and turns the air input adjustment structure at will can also be avoided, so that the users no longer have to readjust the air input amount.

Further, the suction nozzle is sleeved outside the top cover and is rotatable relative to the top cover; and the rotation of the suction nozzle drives the movable member to move axially along the top cover.

With the above structure, the movable member can be moved by rotating the suction nozzle, which realizes stepless adjustment on the air flow of the air inlet. Since the holding area of the suction nozzle is large, the rotation force during the rotation can be conveniently controlled, and the operation is simple and reliable.

Further, the electronic cigarette atomizer further comprises an inverted clamping mechanism for preventing the axial movement of the suction nozzle relative to the top cover.

Since the suction nozzle and the top cover are inversely clamped, the suction nozzle can be prevented from moving axially relative to the top cover.

As a preferred mode, an internal thread bushing is provided in the top cover, and a lower section of a side wall of the movable member is screwed to the internal thread bushing; the rotation of the suction nozzle drives the movable member to rotate relative to threads of the internal thread bushing, while an inner side wall of the internal thread bushing blocks the air passing hole to adjust the amount of air entering the air inlet passage.

With the above structure, the suction nozzle is inversely clamped and connected with the top cover. The inverted clamping mechanism limits the axial movement of the suction nozzle relative to the top cover. When the suction nozzle is rotated, the movable member also rotates relative to the threads of the internal thread bushing under the drive of the suction nozzle, thereby adjusting the area of the air passing hole blocked by the internal thread bushing, to increase or decrease the air flow passing through the air passing hole in a unit time.

As another preferred mode, a connecting sleeve is provided in the housing, and the lower section of the side wall of the movable member is screwed to an upper section of an inner side wall of the connecting sleeve; the rotation of the suction nozzle drives the movable member to rotate relative to threads of the connecting sleeve, while the inner side wall of the connecting sleeve blocks the air passing hole to adjust the amount of air entering the air inlet passage.

Further, an air inlet pipe is further provided in the housing, and an inner cavity of the air inlet pipe forms the air inlet passage; an air inlet end of the air inlet pipe is connected to the movable member, and an air outlet end of the air inlet pipe is opposite to the atomization cavity.

With the above structure, since the air inlet end of the air inlet pipe is connected to the movable member, the movable member drives the air inlet pipe to move during movement, so that the relative positions of the air outlet end of the air inlet pipe and the atomization cavity are changed. When the air input is reduced, the distance between the air outlet end of the air inlet pipe and the atomization cavity is relatively short, so the impact of air flow is large, the smoke emitting effect is good, the concentration of smoke is not reduced while air is adjusted, and the use is not affected.

As a preferred mode, at least two raised ribs parallel to the axis of the suction nozzle are uniformly arranged on the circumference of the inner side wall of the suction nozzle, and the outer side wall of the movable member is provided with positioning planes corresponding to the raised ribs one to one.

The raised ribs cooperate with the positioning planes to achieve a rotation linkage effect.

Further, the inside of a vent at the top of the suction nozzle is provided with a ring portion extending toward the inside of the suction nozzle.

With the above structure, condensed e-liquid can be prevented from being sucked out. Further, the movable member has a cylindrical portion opposite to the vent.

The cylindrical portion can play a role of drainage, which can effectively help the condensed e-liquid at the suction nozzle to flow back, thereby alleviating the condensation of the e-liquid at the suction nozzle.

Further, the top of the cylindrical portion is a tip with an oblique angle, so that the drainage effect is better.

As a preferred mode, the air inlet is formed on the side wall of the top cover.

Since the position of the top cover does not change during the air adjustment process, the air inlet is arranged on the unmovable member to prevent the air inlet from being blocked, and the air is introduced more reliably.

Further, an e-liquid bin is provided in the housing, the suction nozzle is connected to the top cover in a transmission manner by a transmission mechanism, and the suction nozzle drives the top cover to rotate through the transmission mechanism to open or close the e-liquid bin.

With the above structure, the suction nozzle drives the top cover to rotate through the transmission mechanism to open or close the e-liquid bin. The suction nozzle has a large size, so the operation is convenient and saves time and effort.

The suction nozzle not only can adjust the air input of the air inlet by driving the movable member to move axially, but also can drive the top cover through the transmission mechanism to open and close the e-liquid bin for filling e-liquid. The structure is simple, the design is ingenious, the size of the electronic cigarette atomizer is not affected, and the cost is low.

As a preferred mode, the transmission mechanism comprises an internal thread bushing clamped in the top cover, and a top end of the suction nozzle is sleeved outside a top end of the internal thread bushing; and the transmission mechanism further comprises a locking mechanism capable of locking or unlocking the connection position between the suction nozzle and the top cover.

With the above structure, when the e-liquid bin needs to be filled with e-liquid, the connection position between the suction nozzle and the top cover is locked by the locking mechanism, then the suction nozzle is rotated to drive the top cover to rotate, and the e-liquid bin can be opened or closed.

The suction nozzle not only can adjust the air input of the air inlet by driving the movable member to move axially, but also can drive the top cover through the transmission mechanism to open and close the e-liquid bin for filling e-liquid, and also has a child lock function for preventing randomly opening the e-liquid bin. The structure is simple, the design is ingenious, the size of the electronic cigarette atomizer is not affected, and the cost is low.

As a preferred mode, the suction nozzle is axially movable relative to the internal thread bushing, and a travel groove for limiting the axial movement of the suction nozzle is provided on the outer side wall of the internal thread bushing; the locking mechanism comprises a limit groove provided at the bottom end of the suction nozzle, and a limit protrusion provided at the top end of the top cover and capable of matching the limit groove; or the locking mechanism comprises a limit protrusion provided at the bottom end of the suction nozzle, and a limit groove provided at the top end of the top cover and capable of matching the limit protrusion.

With the above structure, when the e-liquid bin needs to be filled with e-liquid, the suction nozzle is pressed down within the travel groove at an effective distance, the limit groove is matched with the limit protrusion, then the suction nozzle is rotated, the suction nozzle drives the top cover to rotate together, and the e-liquid bin can be opened or closed, so the operation is simple and convenient. In addition, when the exposed area of the side wall of the top cover is small, because the e-liquid bin cannot be opened by directly rotating the top cover, this structure can also be used as a reliable "child lock", which can prevent a child from rotating and opening the top cover at will to cause e-liquid leakage, so the safety performance is good.

Further, the electronic cigarette atomizer further comprises a reset spring; one end of the reset spring abuts against the movable member, and the other end of the reset spring abuts against an inner top surface of the suction nozzle.

When the suction nozzle is released by hand, the suction nozzle is reset under the force of the reset spring, so as to avoid the misoperation of the top cover rotates with the suction nozzle, so as to avoid e-liquid leakage.

As another preferred mode, the suction nozzle is axially movable relative to the internal thread bushing, and a travel groove for limiting the axial movement of the suction nozzle is provided on the outer side wall of the internal thread bushing; and the locking mechanism comprises a limit groove provided at the bottom end of the inner side wall of the suction nozzle, and a limit protrusion provided at the top end of the travel groove and capable of matching the limit groove.

With the above structure, when the e-liquid bin needs to be filled with e-liquid, the suction nozzle is pulled up, the limit groove is matched with the limit protrusion, then the suction nozzle is rotated, the suction nozzle drives the top cover to rotate together through the internal thread bushing to open or close the e-liquid. Because the suction nozzle has a large size, the operation is convenient, time-saving, labor-saving, and convenient. In addition, when the exposed area of the side wall of the top cover is small, because the e-liquid bin cannot be opened by directly rotating the top cover, this structure can also be used as a reliable "child lock", which can prevent a child from rotating and opening the top cover at will to cause e-liquid leakage, so the safety performance is good.

Further, the electronic cigarette atomizer further comprises a reset spring; one end of the reset spring abuts against the top end of the travel groove, and the other end of the reset spring abuts against a bottom flange of the inner side wall of the suction nozzle. When the suction nozzle is released by hand, the suction nozzle is reset under the force of the reset spring to avoid the misoperation of the top cover rotates with the suction nozzle, so as to avoid e-liquid leakage.

Based on the same inventive concept, the present invention further provides an electronic cigarette, comprising the electronic cigarette atomizer.

Compared with the prior art, the present invention can quickly and conveniently adjust the required air flow, has good sealing performance, does not affect the smoke emitting effect during the adjustment process, avoids sucking e-liquid. The structure is simple and low in cost. The e-liquid filling operation is simple, convenient, time-saving and effort-saving, can prevent e-liquid leakage due to misoperation, and has good user experience.

Figure 1:
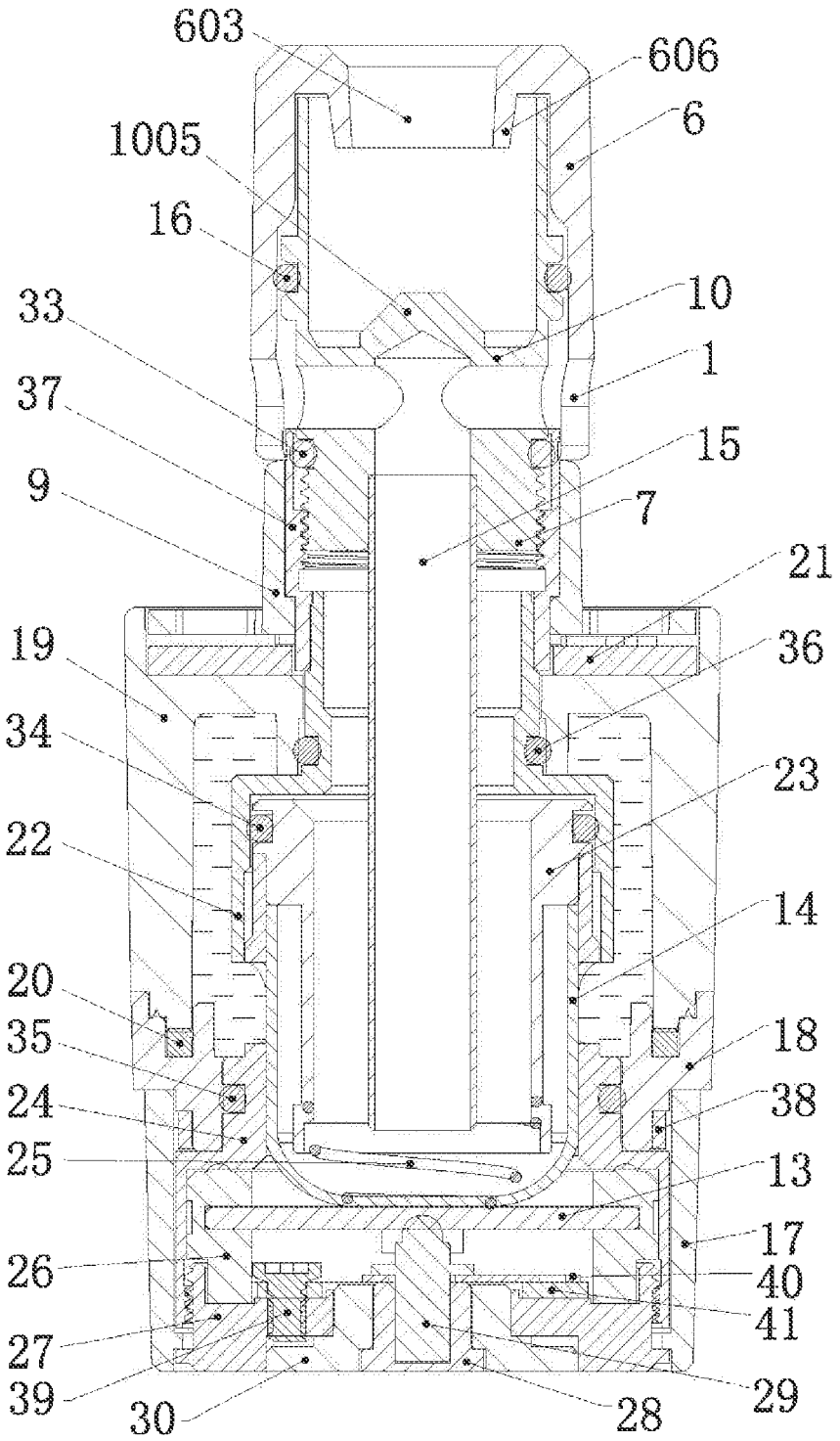
FIG. 1 is a schematic structural diagram of Embodiment 1 of an atomizer.
Figure 2:
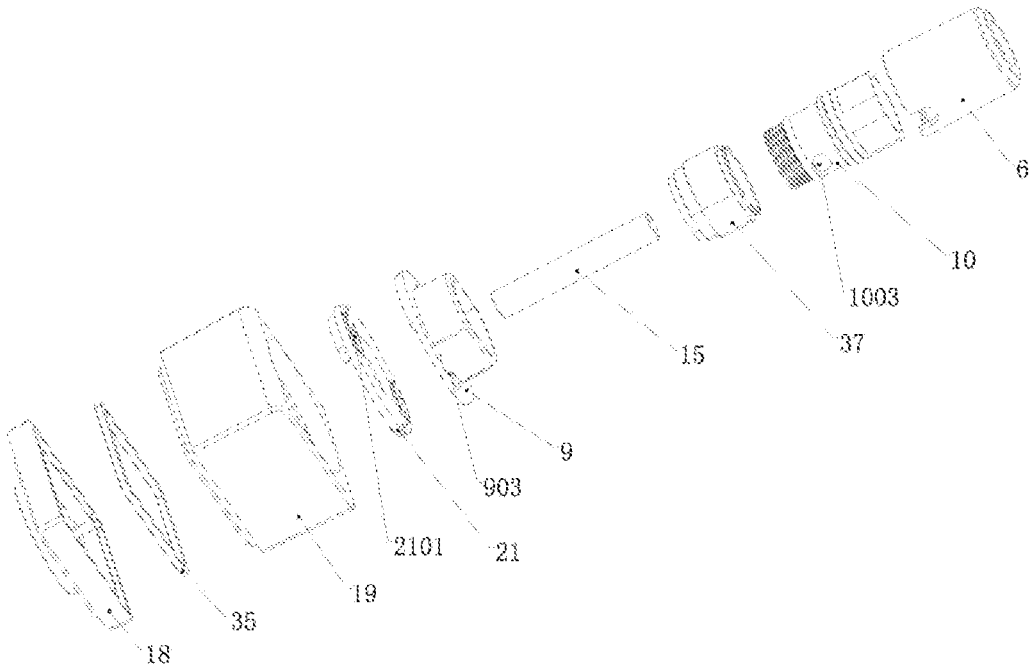
FIG. 2 is an exploded view of the upper part in FIG. 1.

In the figures: 1 air inlet, 2 air inlet passage, 3 atomization cavity, 4 air outlet passage, 5 air outlet, 6 suction nozzle, 603 vent, 604 raised rib, 605 limit groove, 606 ring portion, 7 adjustment mechanism, 8 housing, 9 top cover, 903 e-liquid filling hole, 904 limit protrusion, 905 travel groove, 10 movable member, 1003 air passing hole, 1005 cylindrical portion, 1006 positioning plane, 12 e-liquid bin, 13 ultrasonic atomization sheet, 14 atomization cotton, 15 air inlet pipe, 16 first sealing ring, 17 bottom cover, 18 lower cover, 19 upper cover, 20 second sealing ring, 21 sealing gasket, 2101 through hole, 22 connecting sleeve, 23 inner sleeve, 24 outer sleeve, 25 cotton pressing spring, 26 atomization seat, 27 threaded seat, 28 lower electrode, 29 spring electrode, 30 insulating ring, 33 third sealing ring, 34 fourth sealing ring, 35 fifth sealing ring, 36 sixth sealing ring, 37 internal thread bushing, 38 compression ring, 39 screw, 40 conductive sheet, 41 PCB, 42 fixing seat, 43 reset spring.

DETAILED DESCRIPTION OF EMBODIMENTS

Embodiment 1

As shown in FIGS. 1 to 10, the first embodiment of an electronic cigarette atomizer comprises an air inlet 1, an air inlet passage 2, an atomization cavity 3, an air outlet passage 4, an air outlet 5, and a suction nozzle 6 that are communicated in sequence, and further comprises a housing 8 and an adjustment mechanism 7 for adjusting the air input of the air inlet 1. The air inlet passage 2, the atomization cavity 3, and the air outlet passage 4 are all arranged in the housing 8, and a top of the housing 8 is provided with a top cover 9. The adjustment mechanism 7 comprises a movable member 10 located in the top cover 9 and movable axially along the top cover 9. A first sealing ring 16 is arranged between the movable member 10 and the top cover 9. The movable member 10 is provided with an air passing hole 1003 that communicates the air inlet 1 with the air inlet passage 2, and when the movable member 10 moves axially along the top cover 9, the air passing hole 1003 on the movable member 10 moves in a misaligned manner relative to the air inlet 1 to adjust the amount of air entering the air inlet passage 2.

The suction nozzle 6 is sleeved outside the top cover 9 and is rotatable relative to the top cover 9. The rotation of the suction nozzle 6 drives the movable member 10 to move axially along the top cover 9. The air inlet 1 is formed on a side wall of the suction nozzle 6.

The electronic cigarette atomizer further comprises an inverted clamping mechanism for preventing the axial movement of the suction nozzle 6 relative to the top cover 9. An internal thread bushing 37 is provided in the top cover 9, and a lower section of a side wall of the movable member 10 is screwed to the internal thread bushing 37. The rotation of the suction nozzle 6 drives the movable member 10 to rotate relative to threads of the internal thread bushing 37, while an inner side wall of the internal thread bushing 37 blocks the air passing hole 1003 to adjust the amount of air entering the air inlet passage 2.

An air inlet pipe 15 is further provided in the housing 8, and an inner cavity of the air inlet pipe 15 forms the air inlet passage 2. An air inlet end of the air inlet pipe 15 is connected to the movable member 10, and an air outlet end of the air inlet pipe 15 is opposite to the atomization cavity 3.

An ultrasonic atomization sheet 13 is arranged in the atomization cavity 3. An e-liquid bin 12 and atomization cotton 14 that communicates the e-liquid bin 12 with an atomization surface of the ultrasonic atomization sheet 13 are arranged in the housing 8. The air outlet end of the air inlet pipe 15 is opposite to the atomization cotton 14 on the atomization surface of the ultrasonic atomization sheet 13. The ultrasonic atomization sheet 13 is a piezoelectric ceramic sheet.

Four raised ribs 604 parallel to the axis of the suction nozzle 6 are uniformly arranged on the circumference of the inner side wall of the suction nozzle 6, and the outer side wall of the movable member 10 has positioning planes 1006 corresponding to the raised ribs 604 one to one.

Figure 7:
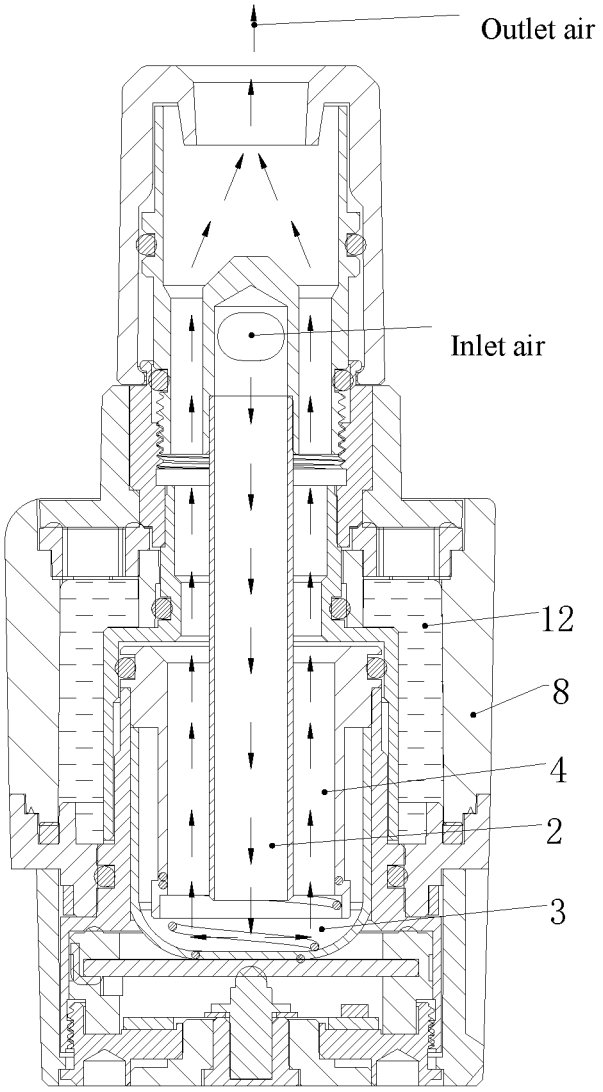
FIG. 7 is a diagram of a use state when the air input of an air inlet is maximum in Embodiment 1.
Figure 8:
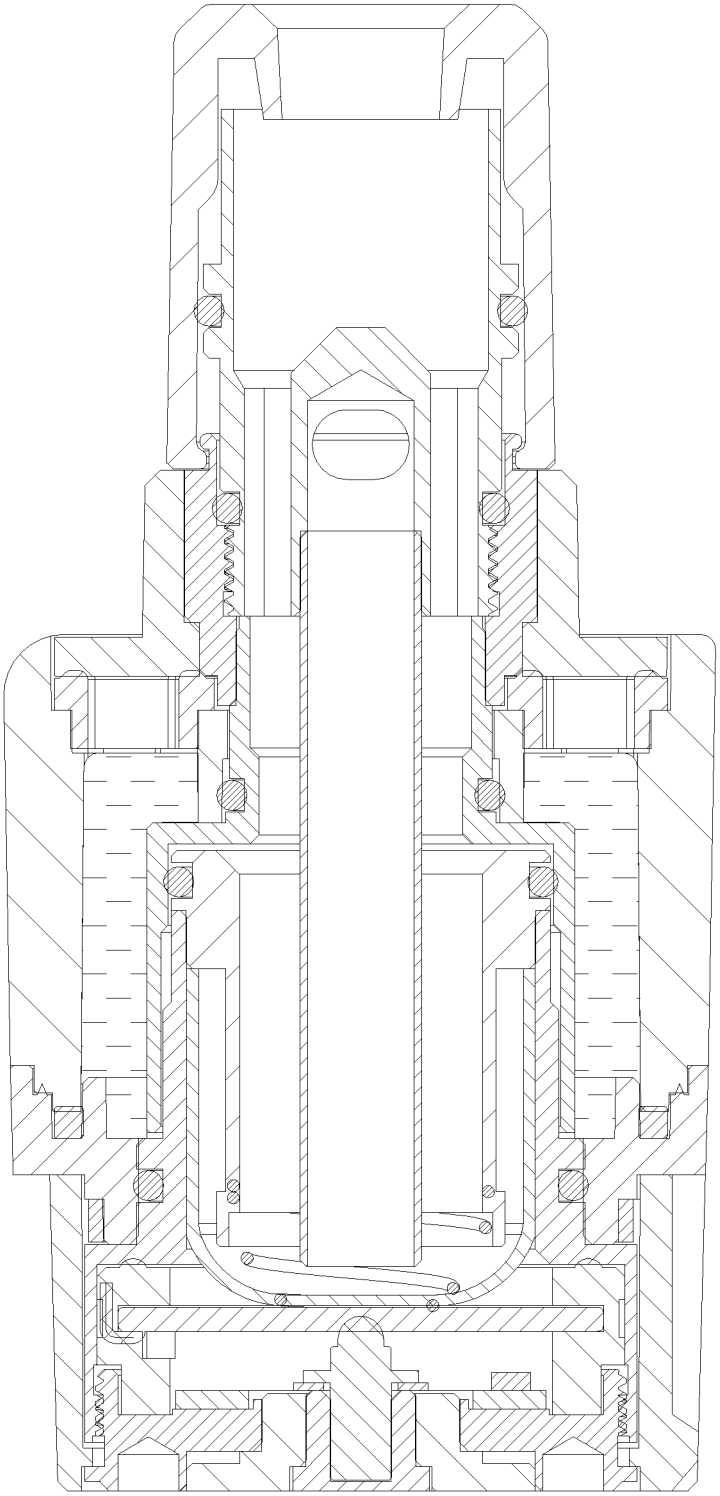
FIG. 8 is a diagram of a use state when the air input of the air inlet is minimum in Embodiment 1.
Figure 9:
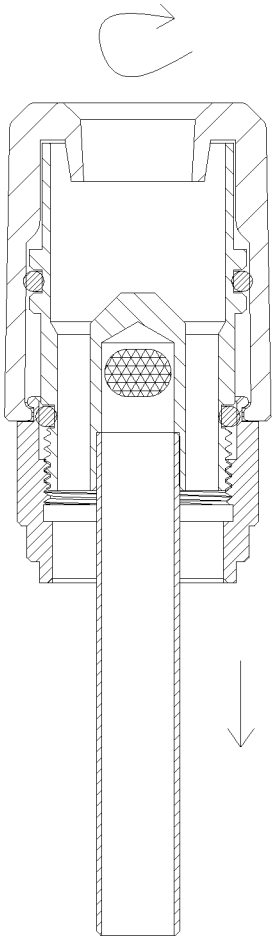
FIG. 9 is a state diagram of the air inlet and an air inlet pipe in FIG. 7.
Figure 10:
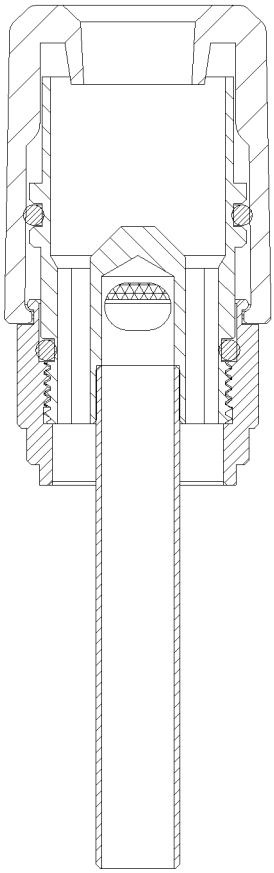
FIG. 10 is a state diagram of the air inlet and the air inlet pipe in FIG. 8.

When the suction nozzle 6 is rotated, the movable member 10 moves axially under the drive of the suction nozzle 6, thereby adjusting the area of the air passing hole 1003 that is blocked by the internal thread bushing 37, to increase or decrease the air flow passing through the air passing hole 1003 in a unit time. When the movable member 10 moves axially, the air inlet pipe 15 also moves axially. In the process of rotating the suction nozzle 6, the change in air passing area of the air passing hole 1003 is shown in FIGS. 7 and 8. The air passing area of the air passing hole 1003 in FIG. 7 is larger than the air passing area of the air passing hole 1003 in FIG. 8, and the distance between the bottom end surface of the air inlet pipe 15 and the inner bottom surface of the atomization cotton 14 in FIG. 7 is longer than the distance between the bottom end surface of the air inlet pipe 15 and the inner bottom surface of the atomization cotton 14 in FIG. 8.

The inside of a vent 603 at the top of the suction nozzle 6 has a ring portion 606 extending toward the inside of the suction nozzle 6.

The movable member 10 has a cylindrical portion 1005 opposite to the vent 603. The top of the cylindrical portion 1005 is a tip with an oblique angle.

The housing 8 comprises a bottom cover 17, a lower cover 18, and an upper cover 19 connected sequentially from bottom to top. A second sealing ring 20 is arranged between the lower cover 18 and the upper cover 19. A compression ring 38 is arranged between the lower cover 18 and the bottom cover 17. A third sealing ring 33 is arranged between the lower cover 10 and the bottom cover 37. The air inlet passage 2 and the air outlet passage 4 have good sealing effect, and do not leak air.

The top cover 9 is an e-liquid filling cover and is provided with an e-liquid filling hole 903. The top cover 9 is connected to a top of the upper cover 19. The e-liquid bin 12 is arranged in the top cover 9. A sealing gasket 21 is arranged between the top of the e-liquid bin 12 and the top cover 9. The sealing gasket 21 is provided with a through hole 2101 capable of communicating the e-liquid filling hole 903 with the e-liquid bin 12. When no e-liquid is filled, the e-liquid filling hole 903 is misaligned with the through hole 2101, and the e-liquid filling hole 903 is closed to prevent e-liquid leakage from the e-liquid bin 12. When e-liquid is filled, the top cover 9 is rotated to communicate the e-liquid filling hole 903 with the through hole 2101, and the e-liquid filling hole 903 is open, so the e-liquid can be injected into the e-liquid bin 12.

A connecting sleeve 22 whose top end is connected to the top cover 9 is further arranged in the upper cover 19. An inner sleeve 23 and an outer sleeve 24 are arranged in the connecting sleeve 22, and the outer sleeve 24 is sleeved outside the inner sleeve 23. A fourth sealing ring 34 is arranged between the inner sleeve 23 and the connecting sleeve 22. A fifth sealing ring 35 is arranged between the outer sleeve 24 and the lower cover 18. A sixth sealing ring 36 is arranged between the connecting sleeve 22 and the upper cover 19. The atomization cotton 14 is cup-shaped, a side wall of the cup-shaped atomization cotton 14 is sandwiched between the inner sleeve 23 and the outer sleeve 24, and an outer bottom surface of the cup-shaped atomization cotton 14 is in contact with the ultrasonic atomization sheet 13. A lower section of the air inlet pipe 15 extends into the inner sleeve 23 and an outlet of the lower section of the air inlet pipe 15 is opposite to the inner bottom surface of the atomization cotton 14. A cotton pressing spring 25 is further arranged in the cup-shaped atomization cotton 14, one end of the cotton pressing spring 25 abuts against the inner sleeve 23, and the other end of the cotton pressing spring 25 abuts against the inner bottom surface of the cup-shaped atomization cotton 14.

The atomization cavity 3 is arranged in the bottom cover 17. The ultrasonic atomization sheet 13 is fixed in the atomization cavity 3 through an atomization seat 26.

A bottom of the bottom cover 17 is provided with a threaded seat 27 for sealing.

A lower electrode 28 is arranged in the threaded seat 27, and the lower electrode 28 abuts against the ultrasonic atomization sheet 13 through a spring electrode 29. The spring electrode 29 is electrically connected to a PCB 41 through a conductive sheet 40. The PCB 41 is connected to the threaded seat 27 by a screw 39. The lower electrode 28 is connected to the threaded seat 27 in an insulating manner by an insulating ring 30.

Embodiment 2

Figure 11:
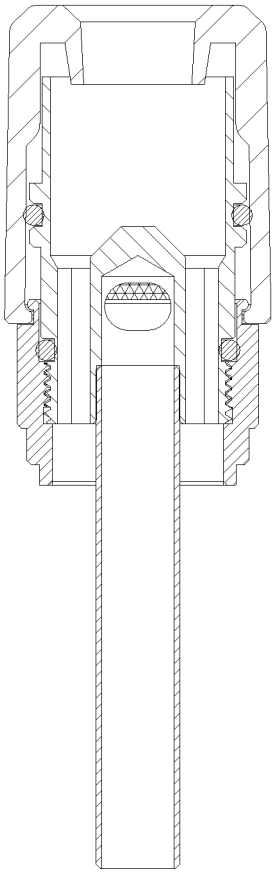
FIG. 11 is a schematic structural diagram of Embodiment 2 of the atomizer.
Figure 12:
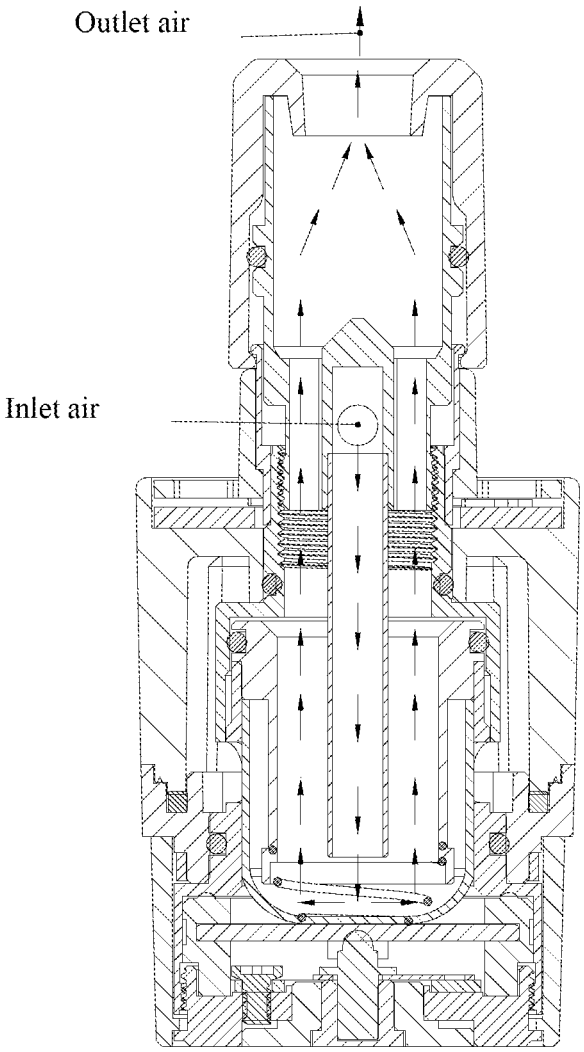
FIG. 12 is a diagram of a use state when the air input of an air inlet is maximum in Embodiment 2.
Figure 13:
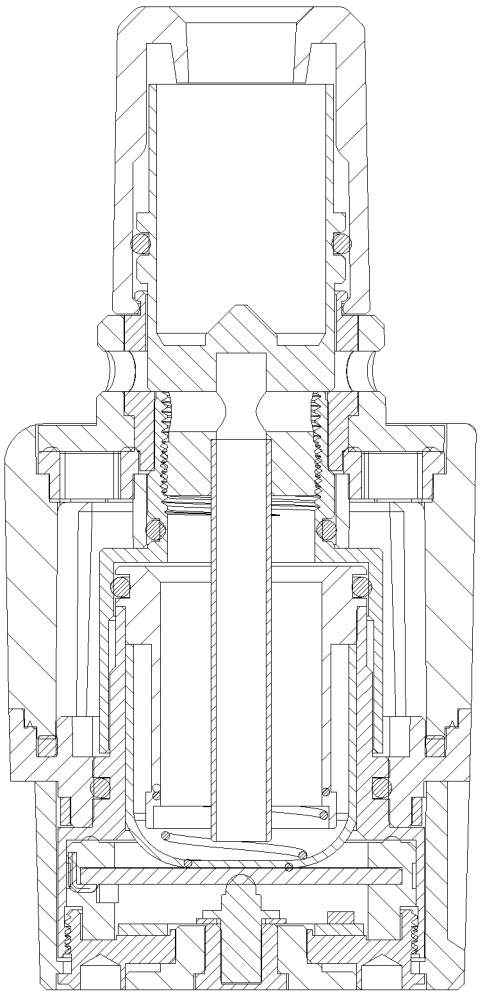
FIG. 13 is a diagram of a use state when the air inlet is fully closed in Embodiment 2.
Figure 14:
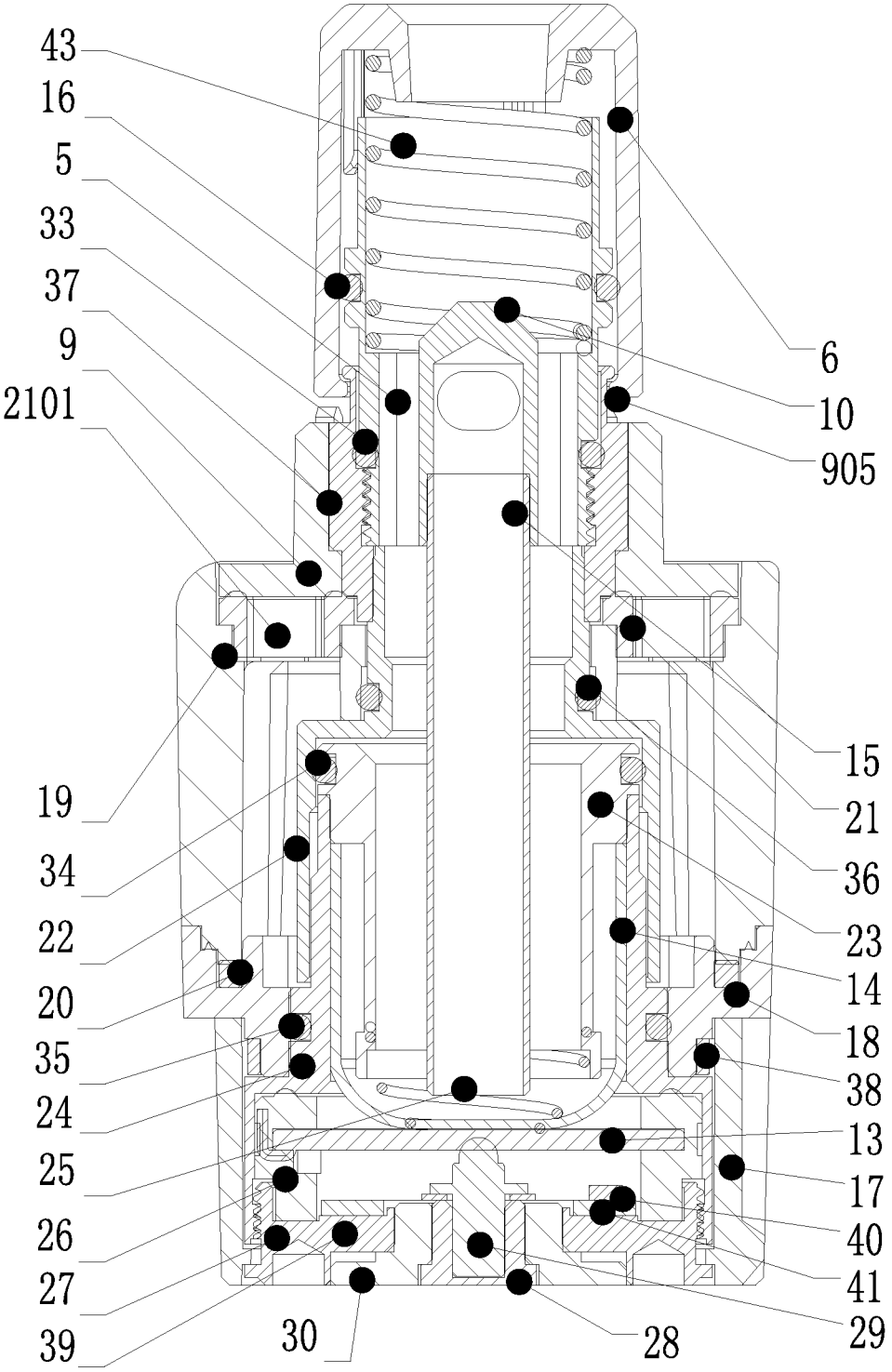
FIG. 14 is a schematic structural diagram of Embodiment 3 of an atomizer.
Figure 15:
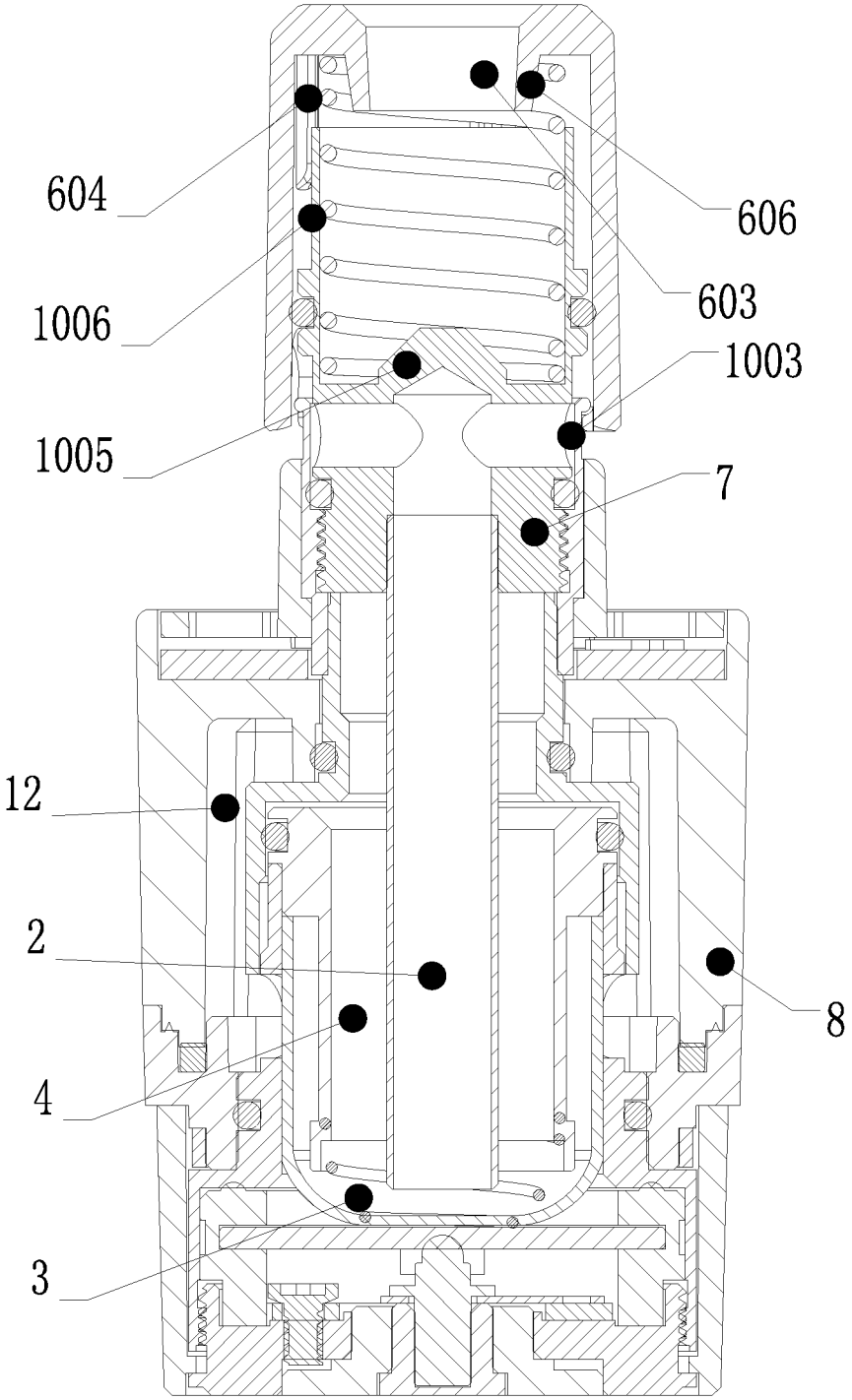
FIG. 15 is a side cross-sectional view of FIG. 14.
Figure 16:
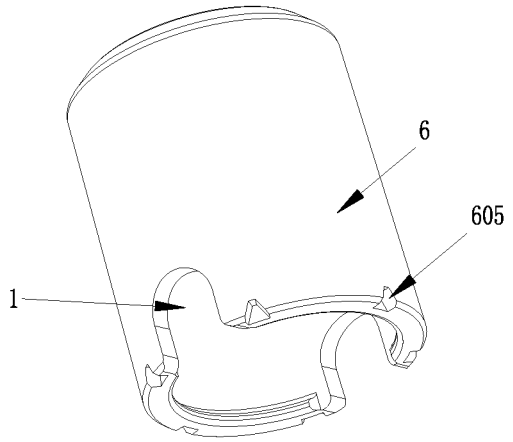
FIG. 16 is a schematic structural diagram of a suction nozzle in FIG. 14.
Figure 17:
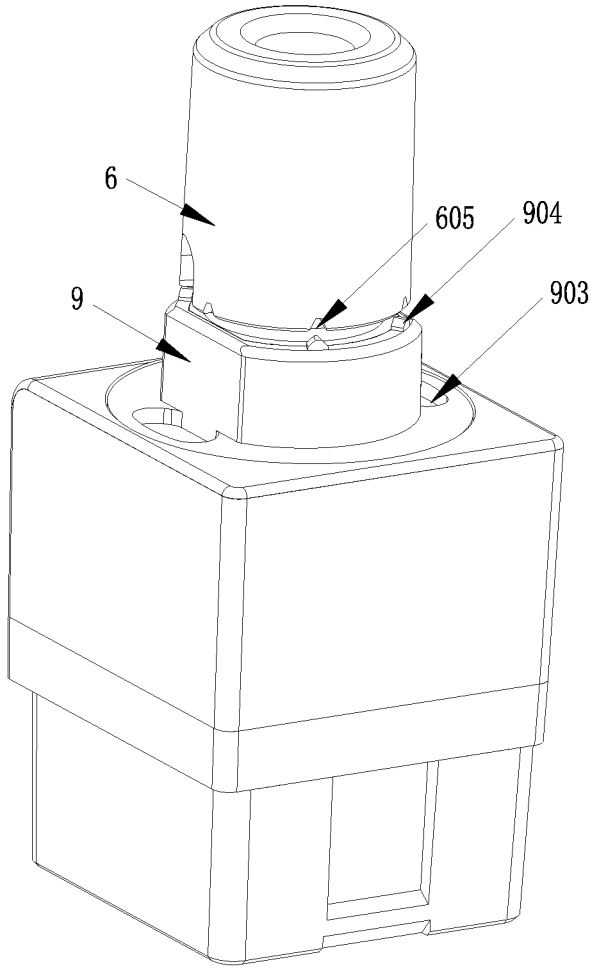
FIG. 17 is an external schematic diagram when the suction nozzle is not locked with an internal thread bushing in FIG. 14.
Figure 18:
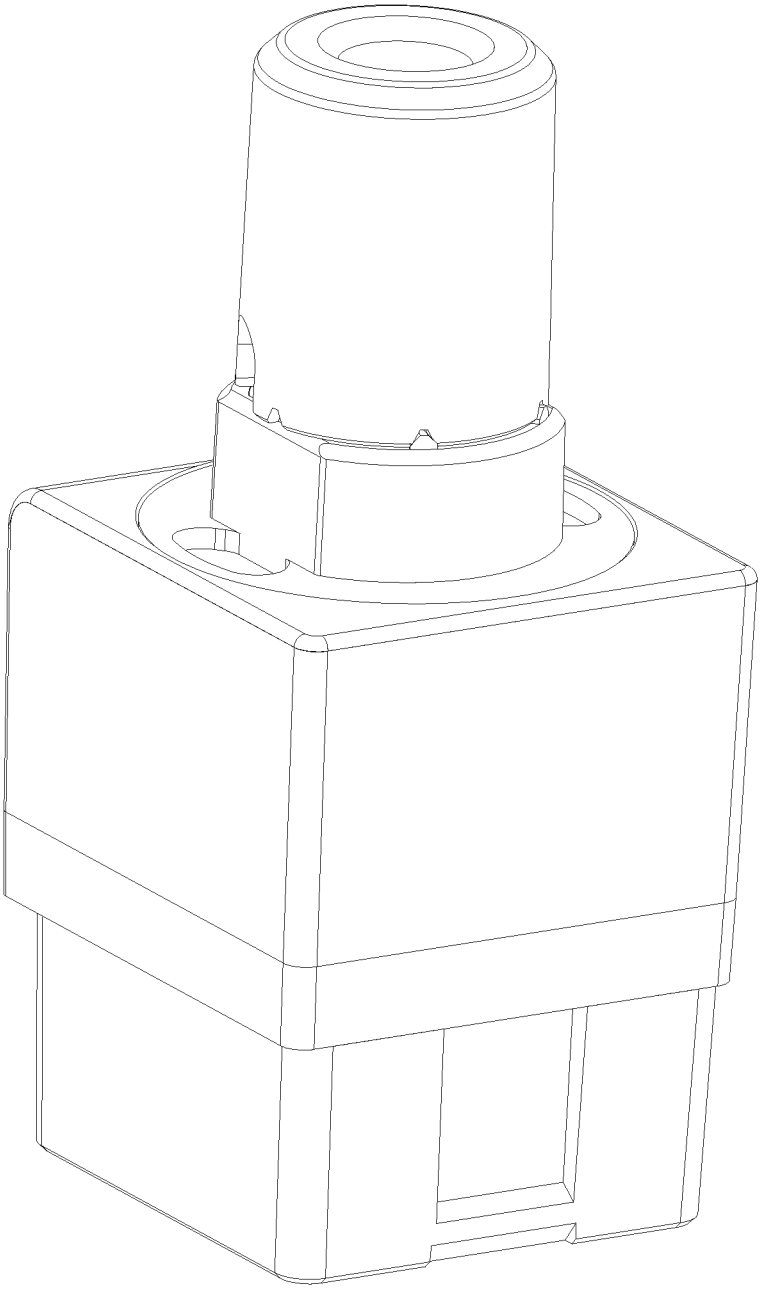
FIG. 18 is an external schematic diagram when the suction nozzle is locked with the internal thread bushing in FIG. 14.
Figure 19:
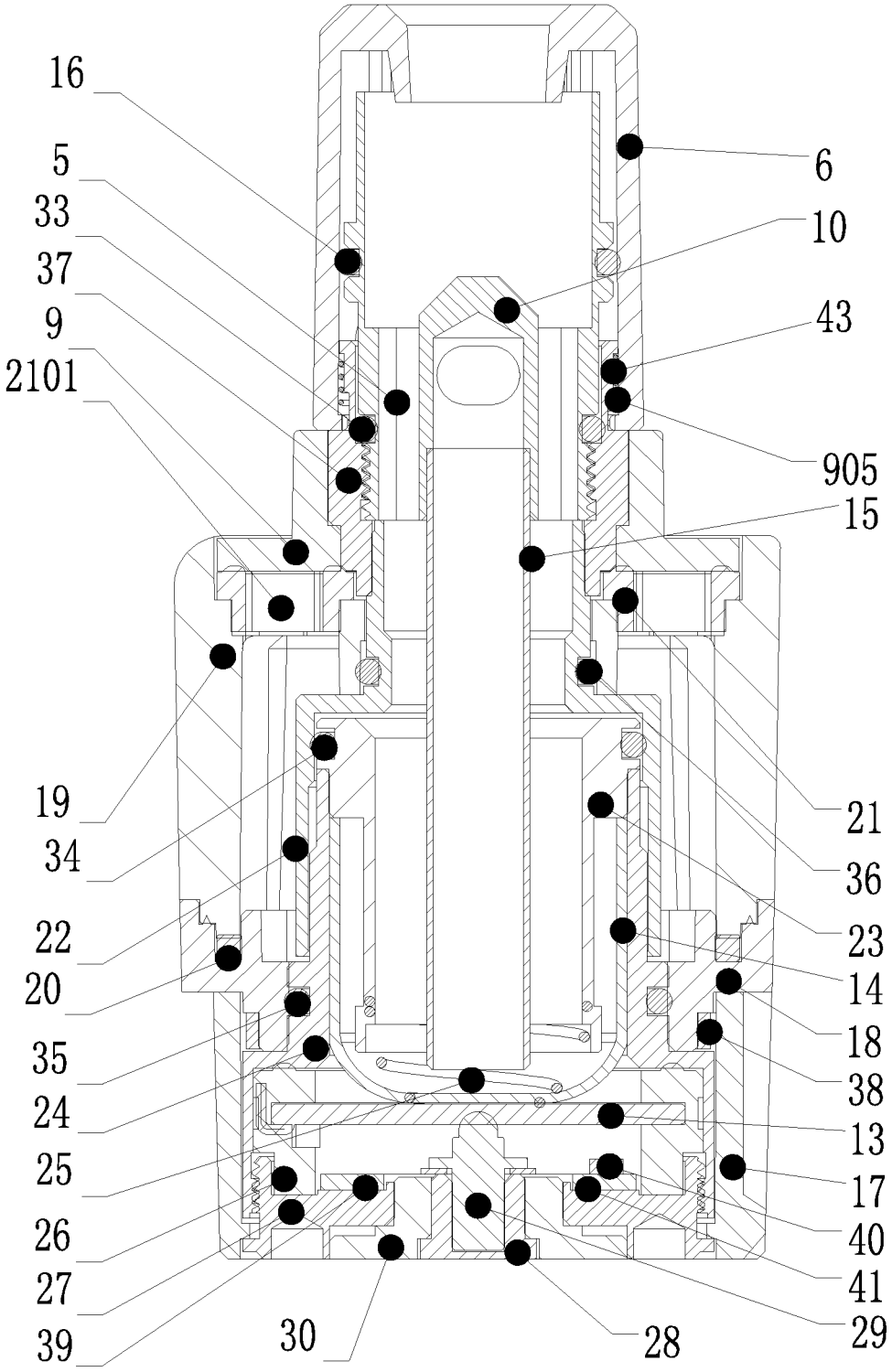
FIG. 19 is a schematic structural diagram of Embodiment 4 of an atomizer.
Figure 20:
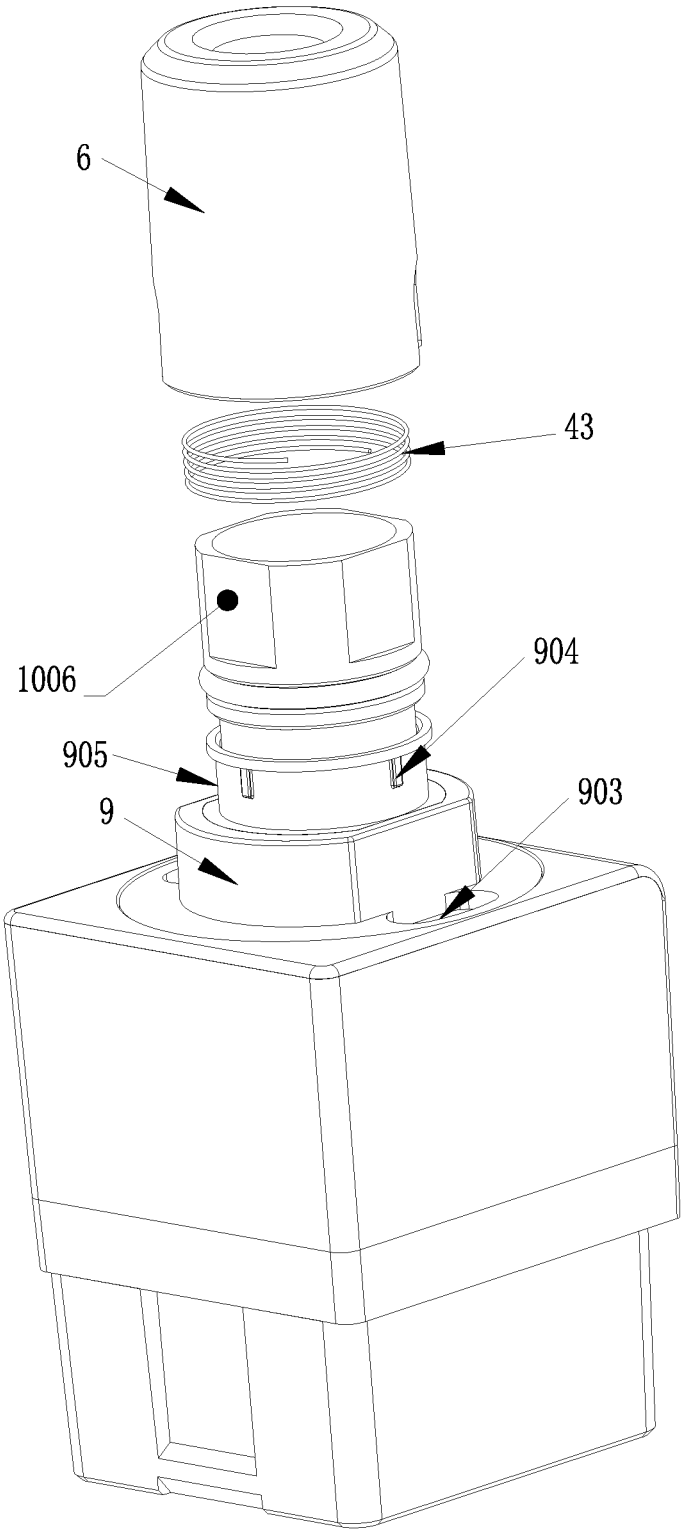
FIG. 20 is an assembly view of FIG. 19.
Figure 21:
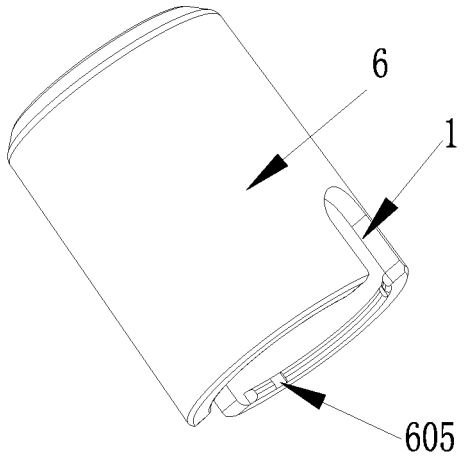
FIG. 21 is a schematic structural diagram of a suction nozzle in FIG. 19.
Figure 22:
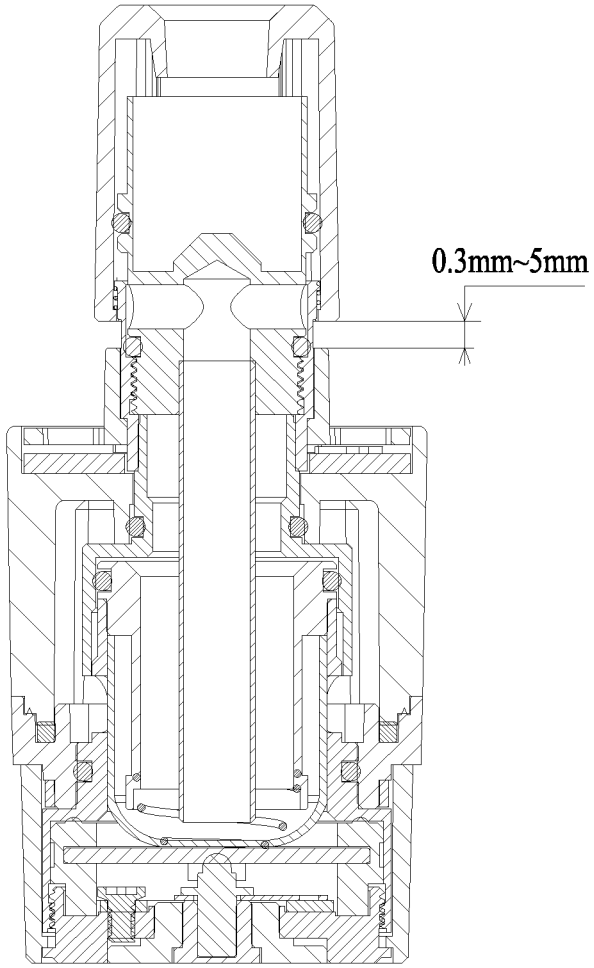
FIG. 22 is a schematic structural diagram when the suction nozzle is locked with an internal thread bushing to rotate a top cover for filling e-liquid in FIG. 19.
Figure 23:
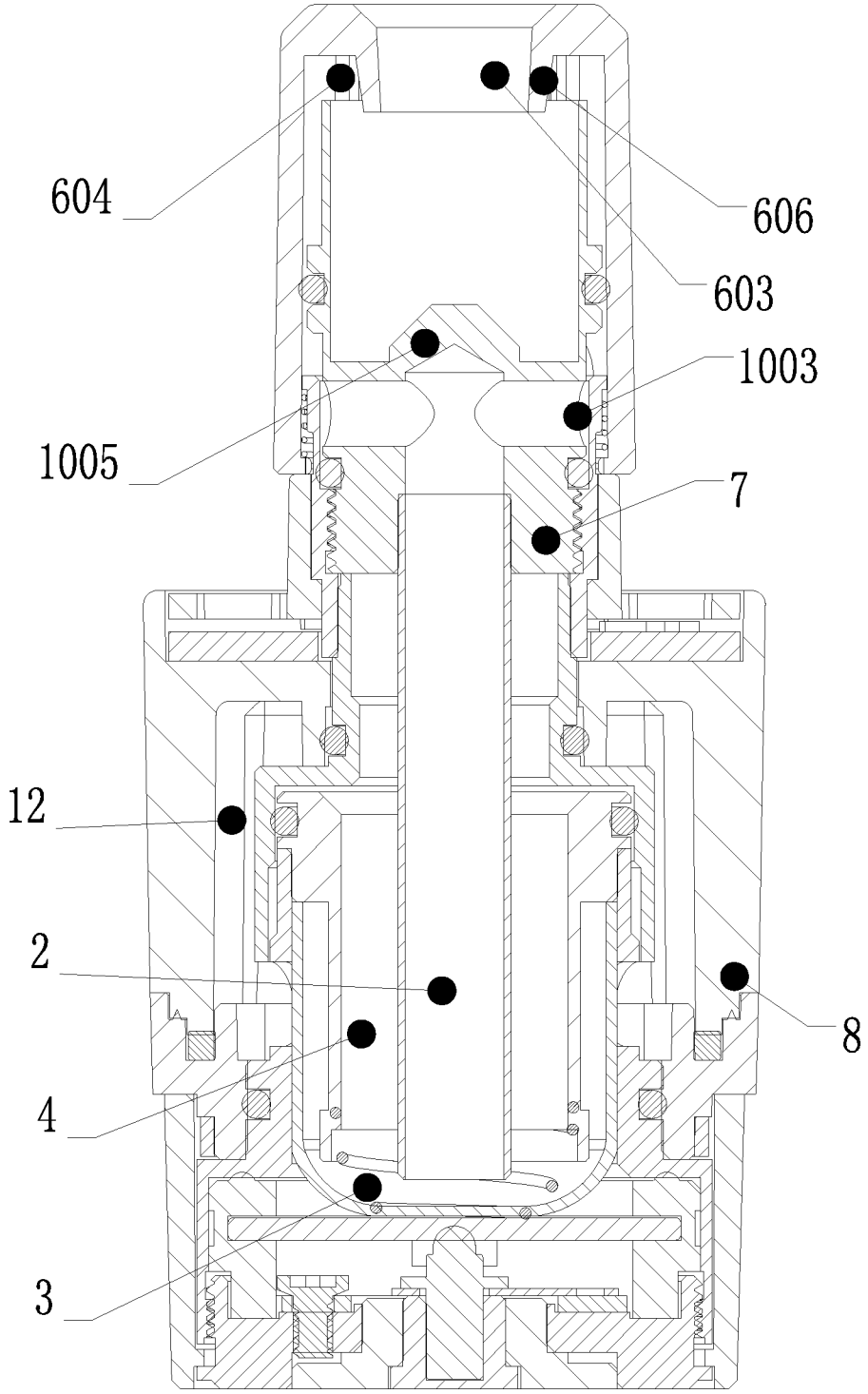
FIG. 23 is a schematic structural diagram when the suction nozzle is not locked with the internal thread bushing to adjust the air input in FIG. 19.

As shown in FIGS. 11 to 13, the second embodiment of an electronic cigarette atomizer repeats the first embodiment, and the differences lie in:

A connecting sleeve 22 is provided in the housing 8, and the lower section of the side wall of the movable member 10 is screwed to an upper section of an inner side wall of the connecting sleeve 22. The rotation of the suction nozzle 6 drives the movable member 10 to rotate relative to threads of the connecting sleeve 22, while the inner side wall of the connecting sleeve 22 blocks the air passing hole 1003 to adjust the amount of air entering the air inlet passage 2. The connecting sleeve 22 and the top cover 9 are fixed by a fixing seat 42.

The air inlet 1 is formed on a side wall of the top cover 9.

Figure 3:
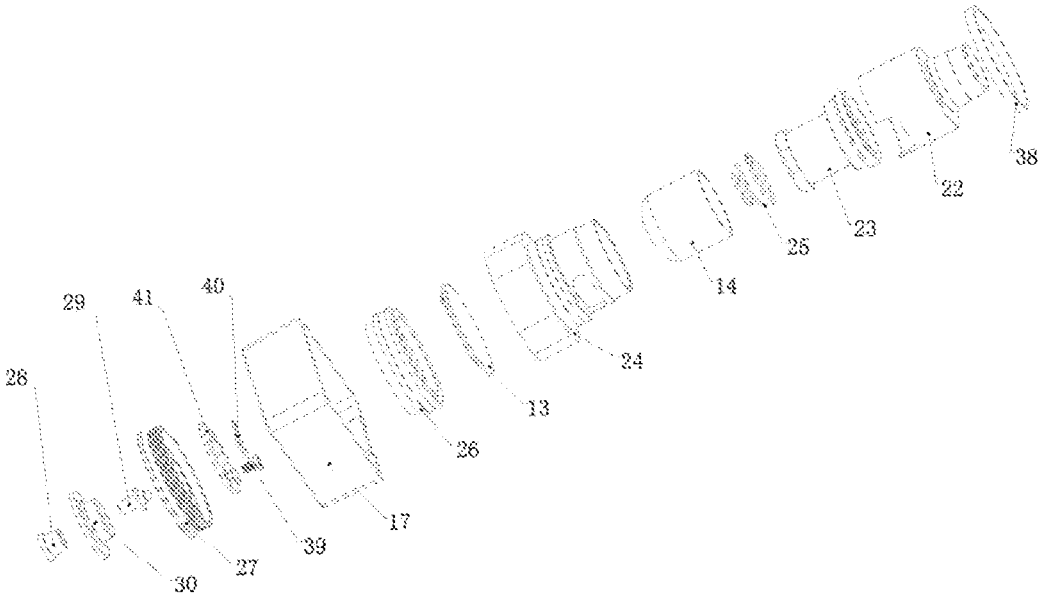
FIG. 3 is an exploded view of the lower part in FIG. 1.
Figure 4:
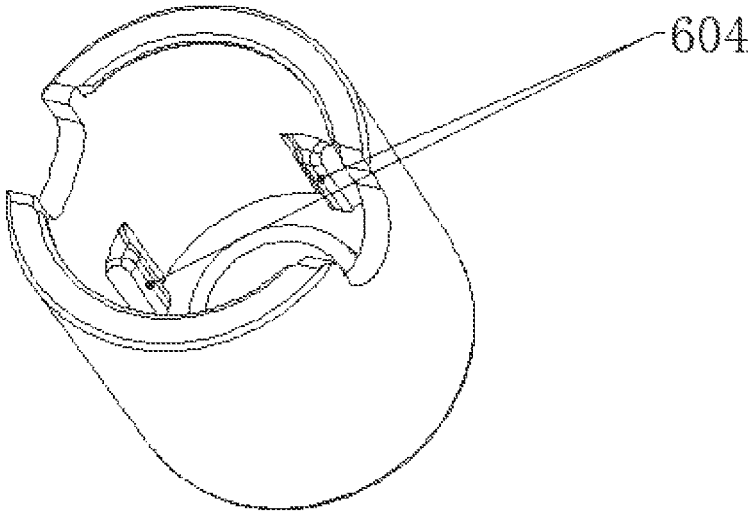
FIG. 4 is a schematic structural diagram of a suction nozzle in FIG. 1.
Figure 5:
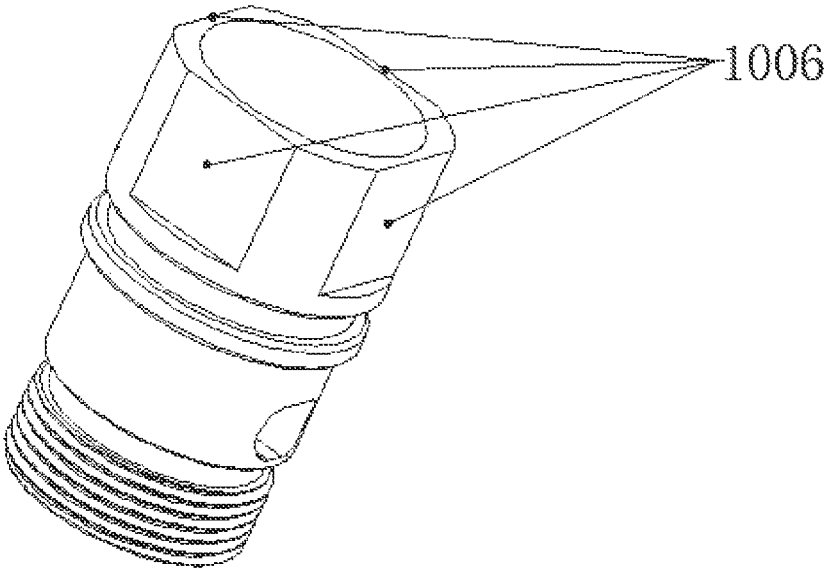
FIG. 5 is a schematic structural diagram of a movable member in FIG. 1.
Figure 6:
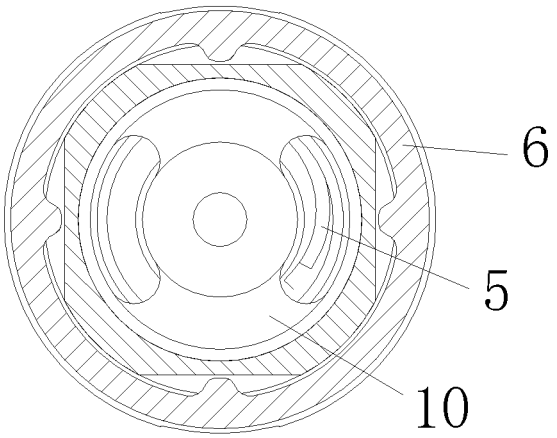
FIG. 6 is a structural diagram of connection between the suction nozzle and the movable member.

In this embodiment, the air passing hole 1003 can be fully closed, to achieve the effect of preventing children from smoking, as shown in FIG. 3.

The same structure in the second embodiment as in the first embodiment is not described herein, which does not affect the understanding and implementation of the present invention by those skilled in the art.

Embodiment 3

As shown in FIGS. 14 to 18, the third embodiment of an electronic cigarette atomizer comprises a housing 8 and a suction nozzle 6. An e-liquid bin 12 is provided in the housing 8, a top of the housing 8 is provided with a top cover 9 that can be used for opening the e-liquid bin 12. The suction nozzle 6 is connected to the top cover 9 in a transmission manner by a transmission mechanism, and the suction nozzle 6 drives the top cover 9 to rotate through the transmission mechanism to open or close the e-liquid bin 12.

The transmission mechanism comprises an internal thread bushing 37 clamped in the top cover 9, and a top end of the suction nozzle 6 is sleeved outside a top end of the internal thread bushing 37. The top end of the internal thread bushing 37 is provided with a buckle (not shown) for limiting the movement of the suction nozzle 6 away from the internal thread bushing 37, so the suction nozzle 6 and the internal thread bushing 37 are fixed by the buckle, and the buckle is riveted to the internal thread bushing 37. The transmission mechanism further comprises a locking mechanism capable of locking or unlocking the connection position between the suction nozzle 6 and the top cover 9.

A lower end of the internal thread bushing 37 is fixed in the top cover 9. The top end of the suction nozzle 6 is sleeved outside the top end of the internal thread bushing 37. The suction nozzle 6 is axially movable relative to the internal thread bushing 37. An outer side wall of the internal thread bushing 37 is provided with a travel groove 905 for limiting the axial movement of the suction nozzle 6. That is, the suction nozzle 6 can move axially within the travel groove 905 of the internal thread bushing 37 to prevent the suction nozzle 6 from falling away from the travel groove 905. The locking mechanism comprises a limit groove 605 provided at the bottom end of the suction nozzle 6, and a limit protrusion 904 provided at the top end of the top cover 9 and capable of matching the limit groove 605 (or the locking mechanism comprises a limit protrusion at the bottom end of the suction nozzle 6, and a limit groove provided at the top end of the top cover 9 and capable of matching the limit groove 605). When the limit groove 605 and the limit protrusion 904 are cooperatively connected, the suction nozzle can be rotated, so that the top cover 9 is driven to rotate together, and the e-liquid filling hole is opened fore-liquid adding.

The suction nozzle 6 is communicated with the air inlet 1 through the air outlet 5, the air outlet passage 4, the atomization cavity 3, and the air inlet passage 2 in turn, and the atomizer further comprises an adjustment mechanism 7 for adjusting the air input of the air inlet 1. The air inlet passage 2, the atomization cavity 3, and the air outlet passage 4 are all arranged in the housing 8, and the adjustment mechanism 7 comprises a movable member 10 located in the top cover 9 and movable axially along the top cover 9. A first sealing ring 16 is arranged between the movable member 10 and the top cover 9. The movable member 10 is provided with an air passing hole 1003 that communicates the air inlet 1 with the air inlet passage 2, and when the movable member 10 moves axially along the top cover 9, the air passing hole 1003 on the movable member 10 moves in a misaligned manner relative to the air inlet 1 to adjust the amount of air entering the air inlet passage 2.

The suction nozzle 6 is sleeved outside the top cover 9 and is rotatable relative to the top cover 9. The rotation of the suction nozzle 6 drives the movable member 10 to move axially along the top cover 9, and the movable member 10 also move axially along the suction nozzle 6. The air inlet 1 is formed on the side wall of the suction nozzle 6. When the movable member 10 moves, the air passing hole 1003 of the movable member 10 is misaligned with the air inlet 1, thereby achieving the effect of adjusting the air input.

A lower section of a side wall of the movable member 10 is screwed to the internal thread bushing 37. The rotation of the suction nozzle 6 drives the movable member 10 to rotate relative to threads of the internal thread bushing 37, while an inner side wall of the internal thread bushing 37 blocks the air passing hole 1003 to adjust the amount of air entering the air inlet passage 2.

The third embodiment of the atomizer further comprises a reset spring 43, one end of the reset spring 43 abuts against the movable member 10, and the other end of the reset spring 43 abuts against an inner top surface of the suction nozzle 6. When e-liquid is filled, the suction nozzle 6 is pressed, the reset spring 43 is compressed, the suction nozzle 6 is disconnected from the movable member 10 and connected with the top cover 9, and then the suction nozzle 6 is rotated to drive the top cover 9 to rotate together, so as to open or close the e-liquid filling hole 903. When the hand loosens, the suction nozzle 6 is bounced by the elastic force of the reset spring 43 to separate from the top cover 9 and connected with the movable member 10. The suction nozzle 6 is rotated at this time to drive the movable member 10 to rotate, so as to adjust the air input.

An air inlet pipe 15 is further provided in the housing 8, and an inner cavity of the air inlet pipe 15 forms the air inlet passage 2. An air inlet end of the air inlet pipe 15 is connected to the movable member 10, and an air outlet end of the air inlet pipe 15 is opposite to the atomization cavity 3. The atomization cavity 3 is a cavity in which a smoke emitting element is provided.

An ultrasonic atomization sheet 13 and atomization cotton 14 that communicates the e-liquid bin 12 with an atomization surface of the ultrasonic atomization sheet 13 are provided in the atomization cavity 3. The air outlet end of the air inlet pipe 15 is opposite to the atomization cotton 14 on the atomization surface of the ultrasonic atomization sheet 13. The ultrasonic atomization sheet 13 is a piezoelectric ceramic sheet.

At least two raised ribs 604 parallel to the axis of the suction nozzle 6 are uniformly arranged on the circumference of the inner side wall of the suction nozzle 6, and the outer side wall of the movable member 10 has positioning planes 1006 corresponding to the raised ribs 604 one to one.

When the e-liquid bin 12 needs to be filled with e-liquid, the suction nozzle 6 is pressed down, the limit groove 605 is matched with the limit protrusion 905, then the suction nozzle 6 is rotated, and the suction nozzle 6 drives the top cover 9 to rotate together, so as to open or close the e-liquid bin 12. When the suction nozzle 6 is released, the suction nozzle 6 moves up and resets under the restoring force of the reset spring 43.

When the inlet air flow needs to be adjusted, the suction nozzle 6 is rotated. Since the raised ribs 604 abut against the positioning planes 1006, the movable member 10 is rotated along with the suction nozzle 6, so that the movable member 10 rotates relative to the threads of the internal thread bushing 37. Meanwhile, the movable member 10 also moves axially along the suction nozzle 6, thereby adjusting the area of the air passing hole 1003 that is blocked by the internal thread bushing 37, to increase or decrease the air flow passing through the air passing hole 1003 in a unit time. When the movable member 10 moves axially, the air inlet pipe 15 also moves axially.

The inside of a vent 603 at the top of the suction nozzle 6 has a ring portion 606 extending toward the inside of the suction nozzle 6.

The movable member 10 has a cylindrical portion 1005 opposite to the vent 603. The top of the cylindrical portion 1005 is a tip with an oblique angle.

The housing 8 comprises a bottom cover 17, a lower cover 18, and an upper cover 19 connected sequentially from bottom to top. A second sealing ring 20 is arranged between the lower cover 18 and the upper cover 19. A compression ring 38 is arranged between the lower cover 18 and the bottom cover 17. A third sealing ring 33 is arranged between the lower cover 10 and the bottom cover 37. The air inlet passage 2 and the air outlet passage 4 have good sealing effect, and do not leak air.

The top cover 9 is provided with an e-liquid filling hole 903. The top cover 9 is connected to a top of the upper cover 18. The e-liquid bin 12 is arranged in the top cover 9. A sealing gasket 21 is arranged between the top of the e-liquid bin 12 and the top cover 9. The sealing gasket 21 is provided with a through hole 2101 capable of communicating the e-liquid filling hole 903 with the e-liquid bin 12. When no e-liquid is filled, the e-liquid filling hole 903 is misaligned with the through hole 2101, and the e-liquid filling hole 903 is closed to prevent e-liquid leakage from the e-liquid bin 12. When e-liquid is filled, the top cover 9 is rotated to communicate the e-liquid filling hole 903 with the through hole 2101, and the e-liquid filling hole 903 is opened to inject the e-liquid into the e-liquid bin 12.

A connecting sleeve 22 whose top end is connected to the top cover 9 is further arranged in the upper cover 18. An inner sleeve 23 and an outer sleeve 24 are arranged in the connecting sleeve 22, and the outer sleeve 24 is sleeved outside the inner sleeve 23. A fourth sealing ring 34 is arranged between the inner sleeve 23 and the connecting sleeve 22. A fifth sealing ring 35 is arranged between the outer sleeve 24 and the lower cover 18. A sixth sealing ring 36 is arranged between the connecting sleeve 22 and the upper cover 18. The atomization cotton 14 is cup-shaped, a side wall of the cup-shaped atomization cotton 14 is sandwiched between the inner sleeve 23 and the outer sleeve 24, and an outer bottom surface of the cup-shaped atomization cotton 14 is in contact with the ultrasonic atomization sheet 13. A lower section of the air inlet pipe 15 extends into the inner sleeve 23 and an outlet of the lower section of the air inlet pipe 15 is opposite to the inner bottom surface of the atomization cotton 14. A cotton pressing spring 25 is further arranged in the cup-shaped atomization cotton 14, one end of the cotton pressing spring 25 abuts against the inner sleeve 23, and the other end of the cotton pressing spring 25 abuts against the inner bottom surface of the cup-shaped atomization cotton 14.

The atomization cavity 3 is arranged in the bottom cover 17. The ultrasonic atomization sheet 13 is fixed in the atomization cavity 3 through an atomization seat 26.

A bottom of the bottom cover 17 is provided with a threaded seat 27 for sealing.

A lower electrode 28 is arranged in the threaded seat 27, and the lower electrode 28 abuts against the ultrasonic atomization sheet 13 through a spring electrode 29. The spring electrode 29 is electrically connected to a PCB 41 through a conductive sheet 40. The PCB 41 is connected to the threaded seat 27 by a screw 39. The lower electrode 28 is connected to the threaded seat 27 in an insulating manner by an insulating ring 30.

Embodiment 4

As shown in FIGS. 19 to 23, the fourth embodiment of the electronic cigarette atomizer comprises a housing 8 and a suction nozzle 6, an e-liquid bin 12 is provided in the housing 8, a top of the housing 8 is provided with a top cover 9 that can be used for opening the e-liquid bin 12, the suction nozzle 6 is connected to the top cover 9 in a transmission manner by a transmission mechanism, and the suction nozzle 6 drives the top cover 9 to rotate through the transmission mechanism to open or close the e-liquid bin 12. The transmission mechanism comprises an internal thread bushing 37 clamped in the top cover 9, and a top end of the suction nozzle 6 is sleeved outside a top end of the internal thread bushing 37. The transmission mechanism further comprises a locking mechanism capable of locking or unlocking the connection position between the suction nozzle 6 and the internal thread bushing 37. The suction nozzle 6 is axially movable relative to the internal thread bushing 37, and a travel groove 905 for limiting the axial movement of the suction nozzle 6 is provided on the outer side wall of the internal thread bushing 37. The locking mechanism comprises a limit groove 605 provided at a bottom end of an inner side wall of the suction nozzle 6, and a limit protrusion 904 provided at a top end of the travel groove 905 and capable of matching the limit groove 605. The travel groove 905 is limited by a distance of 0.3 to 5 mm for pulling out the suction nozzle. The suction nozzle 6 can move axially within the distance range of the travel groove 905, so when the suction nozzle 6 is pulled out and the limit groove 605 and the limit protrusion 904 are cooperatively connected, the suction nozzle 6 can be rotated, the internal thread bushing 37 is driven to rotate together, then the top cover 9 is driven to rotate together, and the e-liquid filling hole is opened to add e-liquid.

The suction nozzle 6 is communicated with the air inlet 1 through the air outlet 5, the air outlet passage 4, the atomization cavity 3, and the air inlet passage 2 in turn, and the atomizer further comprises an adjustment mechanism 7 for adjusting the air input of the air inlet 1. The air inlet passage 2, the atomization cavity 3, and the air outlet passage 4 are all arranged in the housing 8. The adjustment mechanism 7 comprises a movable member 10 located in the top cover 9 and movable axially along the top cover 9. A first sealing ring 16 is arranged between the movable member 10 and the top cover 9. The movable member 10 is provided with an air passing hole 1003 that communicates the air inlet 1 with the air inlet passage 2, and when the movable member 10 moves axially along the top cover 9, the air passing hole 1003 on the movable member 10 moves in a misaligned manner relative to the air inlet 1 to adjust the amount of air entering the air inlet passage 2.

The suction nozzle 6 is sleeved outside the top cover 9 and is rotatable relative to the top cover 9. The rotation of the suction nozzle 6 drives the movable member 10 to move axially along the top cover 9, and the movable member 10 also move axially along the suction nozzle 6. The air inlet 1 is formed on the side wall of the suction nozzle 6. When the movable member 10 moves, the air passing hole 1003 of the movable member 10 is misaligned with the air inlet 1, thereby achieving the effect of adjusting the air input. A lower section of a side wall of the movable member 10 is screwed to the internal thread bushing 37. The rotation of the suction nozzle 6 drives the movable member 10 to rotate relative to threads of the internal thread bushing 37, while an inner side wall of the internal thread bushing 37 blocks the air passing hole 1003 to adjust the amount of air entering the air inlet passage 2.

The fourth embodiment of the atomizer further comprises a reset spring 43, one end of the reset spring 43 abuts against the top end of the travel groove 905, and the other end of the reset spring 43 abuts against a bottom flange of the inner side wall of the suction nozzle 6. When e-liquid is filled, the suction nozzle 6 is pulled out, the reset spring 43 is compressed, the suction nozzle 6 is disconnected from the movable member 10, the suction nozzle 6 is connected with the internal thread bushing 37 by means of twisting or buckling, and then the suction nozzle 6 is rotated to drive the internal thread bushing 37 and the top cover 9 to rotate together, so as to open or close the e-liquid filling hole 903. When the hand loosens, the suction nozzle 6 is bounced by the elastic force of the reset spring 43, the suction nozzle 6 is separated from the internal thread bushing 37, the suction nozzle 6 is connected with the movable member 10 again, and the suction nozzle 6 is rotated at this time to drive the movable member 10 to rotate, so as to adjust the air input.

An air inlet pipe 15 is further provided in the housing 8, and an inner cavity of the air inlet pipe 15 forms the air inlet passage 2. An air inlet end of the air inlet pipe 15 is connected to the movable member 10, and an air outlet end of the air inlet pipe 15 is opposite to the atomization cavity 3.

An ultrasonic atomization sheet 13 and atomization cotton 14 that communicates the e-liquid bin 12 with an atomization surface of the ultrasonic atomization sheet 13 are provided in the atomization cavity 3. The air outlet end of the air inlet pipe 15 is opposite to the atomization cotton 14 on the atomization surface of the ultrasonic atomization sheet 13. The ultrasonic atomization sheet 13 is a piezoelectric ceramic sheet.

At least two raised ribs 604 parallel to the axis of the suction nozzle 6 are uniformly arranged on the circumference of the inner side wall of the suction nozzle 6, and the outer side wall of the movable member 10 has positioning planes 1006 corresponding to the raised ribs 604 one to one.

When the e-liquid bin 12 needs to be filled with e-liquid, the suction nozzle 6 is pulled up, the limit groove 605 is matched with the limit protrusion 905, then the suction nozzle 6 is rotated, and the suction nozzle 6 drives the top cover 9 through the internal thread bushing 37 to rotate together, so as to open or close the e-liquid bin 12. When the suction nozzle 6 is released, the suction nozzle 6 moves down and resets under the restoring force of the reset spring 43.

When the inlet air flow needs to be adjusted, the suction nozzle 6 is rotated. Since the raised ribs 604 abut against the positioning planes 1006, the movable member 10 is rotated along with the suction nozzle 6, so that the movable member 10 rotates relative to the threads of the internal thread bushing 37. Meanwhile, the movable member 10 also moves axially under the drive of the suction nozzle 6, thereby adjusting the area of the air passing hole 1003 that is blocked by the internal thread bushing 37, to increase or decrease the air flow passing through the air passing hole 1003 in a unit time. When the movable member 10 moves axially, the air inlet pipe 15 also moves axially.

The inside of a vent 603 at the top of the suction nozzle 6 has a ring portion 606 extending toward the inside of the suction nozzle 6.

The movable member 10 has a cylindrical portion 1005 opposite to the vent 603.

The top of the cylindrical portion 1005 is a tip with an oblique angle.

The housing 8 comprises a bottom cover 17, a lower cover 18, and an upper cover 19 connected sequentially from bottom to top. A second sealing ring 20 is arranged between the lower cover 18 and the upper cover 19. A compression ring 38 is arranged between the lower cover 18 and the bottom cover 17. A third sealing ring 33 is arranged between the lower cover 10 and the bottom cover 37. The air inlet passage 2 and the air outlet passage 4 have good sealing effect, and do not leak air.

The top cover 9 is provided with an e-liquid injection hole 903. The top cover 9 is connected to a top of the upper cover 18. The e-liquid bin 12 is arranged in the top cover 9. A sealing gasket 21 is arranged between the top of the e-liquid bin 12 and the top cover 9. The sealing gasket 21 is provided with a through hole 2101 capable of communicating the e-liquid injection hole 903 with the e-liquid bin 12. When no e-liquid is filled, the e-liquid filling hole 903 is misaligned with the through hole 2101, and the e-liquid filling hole 903 is closed to prevent e-liquid leakage from the e-liquid bin 12. When e-liquid is filled, the top cover 9 is rotated to communicate the e-liquid filling hole 903 with the through hole 2101, and the e-liquid filling hole 903 is opened to inject the e-liquid into the e-liquid bin 12.

A connecting sleeve 22 whose top end is connected to the top cover 9 is further arranged in the upper cover 18. An inner sleeve 23 and an outer sleeve 24 are arranged in the connecting sleeve 22, and the outer sleeve 24 is sleeved outside the inner sleeve 23. A fourth sealing ring 34 is arranged between the inner sleeve 23 and the connecting sleeve 22. A fifth sealing ring 35 is arranged between the outer sleeve 24 and the lower cover 18. A sixth sealing ring 36 is arranged between the connecting sleeve 22 and the upper cover 18. The atomization cotton 14 is cup-shaped, a side wall of the cup-shaped atomization cotton 14 is sandwiched between the inner sleeve 23 and the outer sleeve 24, and an outer bottom surface of the cup-shaped atomization cotton 14 is in contact with the ultrasonic atomization sheet 13. A lower section of the air inlet pipe 15 extends into the inner sleeve 23 and an outlet of the lower section of the air inlet pipe 15 is opposite to the inner bottom surface of the atomization cotton 14. A cotton pressing spring 25 is further arranged in the cup-shaped atomization cotton 14, one end of the cotton pressing spring 25 abuts against the inner sleeve 23, and the other end of the cotton pressing spring 25 abuts against the inner bottom surface of the cup-shaped atomization cotton 14.

The atomization cavity 3 is arranged in the bottom cover 17. The ultrasonic atomization sheet 13 is fixed in the atomization cavity 3 through an atomization seat 26.

A bottom of the bottom cover 17 is provided with a threaded seat 27 for sealing.

A lower electrode 28 is arranged in the threaded seat 27, and the lower electrode 28 abuts against the ultrasonic atomization sheet 13 through a spring electrode 29. The spring electrode 29 is electrically connected to a PCB 41 through a conductive sheet 40. The PCB 41 is connected to the threaded seat 27 by a screw 39. The lower electrode 28 is connected to the threaded seat 27 in an insulating manner by an insulating ring 30. The embodiments of the present invention are described above with reference to the drawings, but the present invention is not limited to the specific embodiments. The specific embodiments described above are merely illustrative but not restrictive. Many forms may also be made by those of ordinary skill in the art under the enlightenment of the present invention without departing from the purpose of the present invention and the scope of the claims, and these forms fall into the scope of the present invention.

The invention claimed is:

1. An electronic cigarette atomizer, comprising:

an air inlet (1), an air inlet passage (2), an atomization cavity (3), an air outlet passage (4), an air outlet (5), and a suction nozzle (6) that are communicated in sequence, and further comprising a housing (8) and an adjustment mechanism (7) for adjusting an air input of the air inlet (1);

wherein the air inlet passage (2), the atomization cavity (3), and the air outlet passage (4) are all arranged in the housing (8), and a top of the housing (8) is provided with a top cover (9);

wherein:

the adjustment mechanism (7) comprises a movable member (10) located in the top cover (9) and movable axially along the top cover (9), the movable member (10) is provided with an air passing hole (1003) that communicates the air inlet (1) with the air inlet passage (2), when the movable member (10) moves axially along the top cover (9), the air passing hole (1003) on the movable member (10) moves in a misaligned manner relative to the air inlet (1) to adjust an amount of air entering the air inlet passage (2), the suction nozzle (6) is sleeved outside the top cover (9) and is rotatable relative to the top cover (9); and the rotation of the suction nozzle (6) drives the movable member (10) to move axially along the top cover (9), a connecting sleeve (22) is provided in the housing (8), and a lower section of a side wall of the movable member (10) is screwed to an upper section of an inner side wall of the connecting sleeve (22); and the rotation of the suction nozzle (6) drives the movable member (10) to rotate relative to threads of the connecting sleeve (22), while the inner side wall of the connecting sleeve (22) blocks the air passing hole (1003) to adjust the amount of air entering the air inlet passage (2).

2. The electronic cigarette atomizer according to claim 1, further comprising an inverted clamping mechanism for preventing the axial movement of the suction nozzle (6) relative to the top cover (9).

3. The electronic cigarette atomizer according to claim 1, wherein:

an air inlet pipe (15) is further provided in the housing (8), and an inner cavity of the air inlet pipe (15) forms the air inlet passage (2); and an air inlet end of the air inlet pipe (15) is connected to the movable member (10), and an air outlet end of the air inlet pipe (15) is opposite to the atomization cavity (3).

4. The electronic cigarette atomizer according to claim 3, wherein:

an e-liquid bin (12) is provided in the housing (8), the suction nozzle (6) is connected to the top cover (9) in a transmission manner by a transmission mechanism, and the suction nozzle (6) drives the top cover (9) to rotate through the transmission mechanism to open or close the e-liquid bin (12).

5. The electronic cigarette atomizer according to claim 1, wherein:

at least two raised ribs (604) parallel to an axis of the suction nozzle (6) are uniformly arranged on a circumference of an inner side wall of the suction nozzle (6), and an outer side wall of the movable member (10) is provided with positioning planes (1006) corresponding to the raised ribs (604) one to one.

6. The electronic cigarette atomizer according to claim 1, wherein an inside of a vent (603) at a top of the suction nozzle (6) is provided with a ring portion (606) extending toward an inside of the suction nozzle (6).

7. The electronic cigarette atomizer according to claim 6, wherein the movable member (10) has a cylindrical portion (1005) opposite to the vent (603).

8. The electronic cigarette atomizer according to claim 1, wherein the air inlet (1) is formed on a side wall of the top cover (9).

9. The electronic cigarette atomizer according to claim 1, wherein:

an e-liquid bin (12) is provided in the housing (8), the suction nozzle (6) is connected to the top cover (9) in a transmission manner by a transmission mechanism, and the suction nozzle (6) drives the top cover (9) to rotate through the transmission mechanism to open or close the e-liquid bin (12).

10. The electronic cigarette atomizer according to claim 9, wherein:

the transmission mechanism comprises an internal thread bushing (37) clamped in the top cover (9), and a top end of the suction nozzle (6) is sleeved outside a top end of the internal thread bushing (37); and the transmission mechanism further comprises a locking mechanism capable of locking or unlocking the connection position between the suction nozzle (6) and the top cover (9).

11. An electronic cigarette, comprising an electronic cigarette atomizer, wherein the electronic cigarette atomizer comprises:

an air inlet (1), an air inlet passage (2), an atomization cavity (3), an air outlet passage (4), an air outlet (5), and a suction nozzle (6) that are communicated in sequence, and further comprising a housing (8) and an adjustment mechanism (7) for adjusting an air input of the air inlet (1);

wherein the air inlet passage (2), the atomization cavity (3), and the air outlet passage (4) are all arranged in the housing (8), and a top of the housing (8) is provided with a top cover (9);

wherein:

the adjustment mechanism (7) comprises a movable member (10) located in the top cover (9) and movable axially along the top cover (9), the movable member (10) is provided with an air passing hole (1003) that communicates the air inlet (1) with the air inlet passage (2), when the movable member (10) moves axially along the top cover (9), the air passing hole (1003) on the movable member (10) moves in a misaligned manner relative to the air inlet (1) to adjust an amount of air entering the air inlet passage (2), the suction nozzle (6) is sleeved outside the top cover (9) and is rotatable relative to the top cover (9); and the rotation of the suction nozzle (6) drives the movable member (10) to move axially along the top cover (9), a connecting sleeve (22) is provided in the housing (8), and a lower section of a side wall of the movable member (10) is screwed to an upper section of an inner side wall of the connecting sleeve (22); and the rotation of the suction nozzle (6) drives the movable member (10) to rotate relative to threads of the connecting sleeve (22), while the inner side wall of the connecting sleeve (22) blocks the air passing hole (1003) to adjust the amount of air entering the air inlet passage (2).

12. An electronic cigarette atomizer, comprising:

an air inlet (1), an air inlet passage (2), an atomization cavity (3), an air outlet passage (4), an air outlet (5), and a suction nozzle (6) that are communicated in sequence, and further comprising a housing (8) and an adjustment mechanism (7) for adjusting an air input of the air inlet (1);

wherein the air inlet passage (2), the atomization cavity (3), and the air outlet passage (4) are all arranged in the housing (8), and a top of the housing (8) is provided with a top cover (9);

wherein:

the adjustment mechanism (7) comprises a movable member (10) located in the top cover (9) and movable axially along the top cover (9), the movable member (10) is provided with an air passing hole (1003) that communicates the air inlet (1) with the air inlet passage (2), when the movable member (10) moves axially along the top cover (9), the air passing hole (1003) on the movable member (10) moves in a misaligned manner relative to the air inlet (1) to adjust an amount of air entering the air inlet passage (2), an inside of a vent (603) at a top of the suction nozzle (6) is provided with a ring portion (606) extending toward an inside of the suction nozzle (6), wherein the movable member (10) has a cylindrical portion (1005) opposite to the vent (603).

13. The electronic cigarette atomizer according to claim 12, wherein a top of the cylindrical portion (1005) is a tip with an oblique angle.

14. The electronic cigarette atomizer according to claim 12, wherein:

an e-liquid bin (12) is provided in the housing (8), the suction nozzle (6) is connected to the top cover (9) in a transmission manner by a transmission mechanism, and the suction nozzle (6) drives the top cover (9) to rotate through the transmission mechanism to open or close the e-liquid bin (12).

15. An electronic cigarette atomizer, comprising:

an air inlet (1), an air inlet passage (2), an atomization cavity (3), an air outlet passage (4), an air outlet (5), and a suction nozzle (6) that are communicated in sequence, and further comprising a housing (8) and an adjustment mechanism (7) for adjusting an air input of the air inlet (1);

wherein the air inlet passage (2), the atomization cavity (3), and the air outlet passage (4) are all arranged in the housing (8), and a top of the housing (8) is provided with a top cover (9);

wherein:

the adjustment mechanism (7) comprises a movable member (10) located in the top cover (9) and movable axially along the top cover (9), the movable member (10) is provided with an air passing hole (1003) that communicates the air inlet (1) with the air inlet passage (2), when the movable member (10) moves axially along the top cover (9), the air passing hole (1003) on the movable member (10) moves in a misaligned manner relative to the air inlet (1) to adjust an amount of air entering the air inlet passage (2), an e-liquid bin (12) is provided in the housing (8), the suction nozzle (6) is connected to the top cover (9) in a transmission manner by a transmission mechanism, the suction nozzle (6) drives the top cover (9) to rotate through the transmission mechanism to open or close the e-liquid bin (12), the transmission mechanism comprises an internal thread bushing (37) clamped in the top cover (9), and a top end of the suction nozzle (6) is sleeved outside a top end of the internal thread bushing (37); and the transmission mechanism further comprises a locking mechanism capable of locking or unlocking the connection position between the suction nozzle (6) and the top cover (9).

16. The electronic cigarette atomizer according to claim 15, wherein:

the suction nozzle (6) is axially movable relative to an internal thread bushing (37), and a travel groove (905) for limiting the axial movement of the suction nozzle (6) is provided on an outer side wall of the internal thread bushing (37);

the locking mechanism comprises a limit groove (605) provided at a bottom end of the suction nozzle (6), and a limit protrusion (904) provided at a top end of the top cover (9) and capable of matching the limit groove (605); or the locking mechanism comprises a limit protrusion provided at the bottom end of the suction nozzle (6), and a limit groove provided at the top end of the top cover (9) and capable of matching the limit protrusion.

17. The electronic cigarette atomizer according to claim 16, further comprising a reset spring (43); wherein one end of the reset spring (43) abuts against the movable member (10), and the other end of the reset spring (43) abuts against an inner top surface of the suction nozzle (6).

18. The electronic cigarette atomizer according to claim 15, wherein:

the suction nozzle (6) is axially movable relative to the internal thread bushing (37), and a travel groove (905) for limiting the axial movement of the suction nozzle (6) is provided on an outer side wall of the internal thread bushing (37); and the locking mechanism comprises a limit groove (605) provided at a bottom end of an inner side wall of the suction nozzle (6), and a limit protrusion (904) provided at a top end of the travel groove (905) and capable of matching the limit groove (605).

19. The electronic cigarette atomizer according to claim 18, further comprising a reset spring (43); wherein one end of the reset spring (43) abuts against the top end of the travel groove (905), and the other end of the reset spring (43) abuts against a bottom flange of the inner side wall of the suction nozzle (6).

20. An electronic cigarette atomizer, comprising:

an air inlet (1), an air inlet passage (2), an atomization cavity (3), an air outlet passage (4), an air outlet (5), and a suction nozzle (6) that are communicated in sequence, and further comprising a housing (8) and an adjustment mechanism (7) for adjusting an air input of the air inlet (1);

wherein the air inlet passage (2), the atomization cavity (3), and the air outlet passage (4) are all arranged in the housing (8), and a top of the housing (8) is provided with a top cover (9);

wherein:

the adjustment mechanism (7) comprises a movable member (10) located in the top cover (9) and movable axially along the top cover (9), the movable member (10) is provided with an air passing hole (1003) that communicates the air inlet (1) with the air inlet passage (2), when the movable member (10) moves axially along the top cover (9), the air passing hole (1003) on the movable member (10) moves in a misaligned manner relative to the air inlet (1) to adjust an amount of air entering the air inlet passage (2), the suction nozzle (6) is sleeved outside the top cover (9) and is rotatable relative to the top cover (9); and the rotation of the suction nozzle (6) drives the movable member (10) to move axially along the top cover (9), an internal thread bushing (37) is provided in the top cover (9), and a lower section of a side wall of the movable member (10) is screwed to the internal thread bushing (37); and the rotation of the suction nozzle (6) drives the movable member (10) to rotate relative to threads of the internal thread bushing (37), while an inner side wall of the internal thread bushing (37) blocks the air passing hole (1003) to adjust the amount of air entering the air inlet passage (2).

* * * * *